US011198033B2

(12) United States Patent
Yim et al.

(10) Patent No.: US 11,198,033 B2
(45) **Date of Patent: *Dec. 14, 2021**

(54) EXERCISE MACHINE

(71) Applicant: NAUTILUS, INC., Vancouver, WA (US)

(72) Inventors: Rasmey Yim, Vancouver, WA (US); Marcus L. Marjama, Vancouver, WA (US); Kevin M. Hendricks, Portland, OR (US)

(73) Assignee: Nautilus, Inc., Vancouver, WA (US)

( * ) Notice: Subject to any disclaimer, the term of this patent is extended or adjusted under 35 U.S.C. 154(b) by 17 days.

This patent is subject to a terminal disclaimer.

(21) Appl. No.: 16/378,221

(22) Filed: Apr. 8, 2019

(65) Prior Publication Data

US 2019/0232104 A1 Aug. 1, 2019

Related U.S. Application Data

(63) Continuation of application No. 15/970,627, filed on May 3, 2018, now Pat. No. 10,252,101, which is a (Continued)

(51) Int. Cl.
*A63B 22/00* (2006.01)
*A63B 22/06* (2006.01)

(Continued)

(52) U.S. Cl.
CPC ..... *A63B 22/001* (2013.01); *A63B 21/00076* (2013.01); *A63B 21/0085* (2013.01);

(Continued)

(58) Field of Classification Search
CPC ..... A63B 2022/0043; A63B 2022/06; A63B 2022/001; A63B 2022/0017;

(Continued)

(56) References Cited

U.S. PATENT DOCUMENTS 219,439 A 9/1879 Blend
3,134,378 A 5/1964 Harwood (Continued)

FOREIGN PATENT DOCUMENTS

CN 101417170 A 4/2009
EP 0323056 A2 7/1989

(Continued)

OTHER PUBLICATIONS

Extended European Search Report, Application No. 17194219.6, dated May 22, 2018, 13 pages.

(Continued)

*Primary Examiner* — Megan Anderson
(74) *Attorney, Agent, or Firm* — Dorsey & Whitney LLP

(57) ABSTRACT

Described herein are embodiments of stationary exercise machines having reciprocating foot and/or hand members, such as foot pedals that move in a closed loop path. Some embodiments can include reciprocating foot pedals that cause a user's feet to move along a closed loop path that is substantially inclined, such that the foot motion simulates a climbing motion more than a flat walking or running motion. Some embodiments can further include reciprocating handles that are configured to move in coordination with the foot via a linkage to a crank wheel also coupled to the foot pedals. Variable resistance can be provided via a rotating air-resistance based mechanism, via a magnetism based mechanism, and/or via other mechanisms, one or more of which can be rapidly adjustable while the user is using the machine.

15 Claims, 33 Drawing Sheets

Related U.S. Application Data continuation of application No. 14/954,144, filed on Nov. 30, 2015, now Pat. No. 9,987,513, which is a continuation of application No. 14/218,808, filed on Mar. 18, 2014, now Pat. No. 9,199,115, which is a continuation of application No. PCT/US2014/030875, filed on Mar. 17, 2014.

(60) Provisional application No. 61/798,663, filed on Mar. 15, 2013.

(51) Int. Cl.

| | |
|---|---|
| ***A63B 21/00*** | (2006.01) |
| ***A63B 21/008*** | (2006.01) |
| ***A63B 23/035*** | (2006.01) |
| *A63B 24/00* | (2006.01) |
| *A63B 21/005* | (2006.01) |

(52) U.S. Cl.

CPC .... *A63B 21/00192* (2013.01); *A63B 21/4034* (2015.10); *A63B 21/4035* (2015.10); *A63B 22/0015* (2013.01); *A63B 22/0017* (2015.10); *A63B 22/0056* (2013.01); *A63B 22/0664* (2013.01); *A63B 23/03516* (2013.01); *A63B 21/005* (2013.01); *A63B 21/0051* (2013.01); *A63B 21/0088* (2013.01); *A63B 23/03591* (2013.01); *A63B 24/0087* (2013.01); *A63B 2022/0043* (2013.01); *A63B 2022/0676* (2013.01); *A63B 2024/0093* (2013.01)

(58) Field of Classification Search

CPC ..... A63B 2022/0015; A63B 2022/067; A63B 2022/0676; A63B 2022/0682; A63B 23/03591; A63B 23/03516; A63B 21/00076; A63B 21/00192; A63B 21/0051; A63B 21/005; A63B 21/0088; A63B 21/4034; A63B 21/4035; A63B 2024/0093

See application file for complete search history.

(56) References Cited

U.S. PATENT DOCUMENTS

| | | | | |
|---|---|---|---|---|
| 3,213,852 | A | 10/1965 | Zent | |
| 3,964,742 | A | 6/1976 | Carnielli | |
| 4,880,225 | A | 11/1989 | Lucas et al. | |
| 5,048,824 | A | 9/1991 | Chen | |
| 5,051,638 | A | 9/1991 | Pyles | |
| 5,242,343 | A | 9/1993 | Miller | |
| 5,290,211 | A | 3/1994 | Stearns | |
| 5,290,212 | A | 3/1994 | Metcalf | |
| 5,383,829 | A | 1/1995 | Miller | |
| 5,499,956 | A | 3/1996 | Habing et al. | |
| 5,518,473 | A | 5/1996 | Miller | |
| 5,529,555 | A | 6/1996 | Rodgers, Jr. | |
| 5,540,637 | A | 7/1996 | Rodgers, Jr. | |
| 5,549,526 | A | 8/1996 | Rodgers, Jr. | |
| 5,562,574 | A | 10/1996 | Miller | |
| 5,573,480 | A | 11/1996 | Rodgers, Jr. | |
| 5,577,985 | A | 11/1996 | Miller | |
| 5,593,371 | A | 1/1997 | Rodgers, Jr. | |
| 5,593,372 | A | 1/1997 | Rodgers, Jr. | |
| 5,595,553 | A | 1/1997 | Rodgers, Jr. | |
| 5,611,758 | A | 3/1997 | Rodgers, Jr. | |
| 5,653,662 | A | 8/1997 | Rodgers, Jr. | |
| 5,683,330 | A | 11/1997 | Kobayashi | |
| 5,685,804 | A | 11/1997 | Whan-Tong | |
| 5,690,589 | A | 11/1997 | Rodgers, Jr. | |
| 5,707,321 | A | 1/1998 | Maresh | |
| 5,738,614 | A | 4/1998 | Rodgers, Jr. | |
| 5,743,834 | A | 4/1998 | Rodgers, Jr. | |
| 5,795,270 | A | 8/1998 | Woods et al. | |
| 5,836,855 | A | 11/1998 | Eschenbach | |
| 5,997,445 | A | 12/1999 | Maresh et al. | |
| 6,019,710 | A | 2/2000 | Dalebout et al. | |
| 6,024,676 | A | 2/2000 | Eschenbach | |
| 6,206,806 | B1 | 3/2001 | Chu | |
| 6,422,977 | B1 | 7/2002 | Eschenbach | |
| D512,112 | S | 11/2005 | Nagano | |
| 7,086,993 | B1 | 8/2006 | Maresh | |
| 7,201,705 | B2 | 4/2007 | Rodgers, Jr. | |
| 7,238,146 | B1 | 7/2007 | Chen | |
| D559,925 | S | 1/2008 | Horita | |
| D565,129 | S | 3/2008 | Chang et al. | |
| D567,310 | S | 4/2008 | Chen et al. | |
| D567,314 | S | 4/2008 | Horita | |
| 7,377,879 | B1 | 5/2008 | Chen | |
| D575,363 | S | 8/2008 | Horita | |
| 7,448,986 | B1 | 11/2008 | Porth | |
| 7,455,624 | B2 | 11/2008 | Liao Lai | |
| 7,462,134 | B2 | 12/2008 | Lull et al. | |
| 7,494,447 | B2 * | 2/2009 | Eschenbach | A63B 21/154 482/52 |
| 7,556,591 | B2 | 7/2009 | Chuang et al. | |
| 7,591,761 | B1 | 9/2009 | Ellis | |
| 7,611,446 | B2 | 11/2009 | Chuang et al. | |
| 7,618,350 | B2 | 11/2009 | Dalebout et al. | |
| D606,599 | S | 12/2009 | Murray et al. | |
| 7,666,122 | B2 | 2/2010 | Chiles et al. | |
| 7,674,205 | B2 | 3/2010 | Dalebout et al. | |
| 7,736,278 | B2 | 6/2010 | Lull et al. | |
| 7,785,235 | B2 | 8/2010 | Lull et al. | |
| 7,789,808 | B2 | 9/2010 | Lee et al. | |
| 7,811,206 | B2 | 10/2010 | Chuang et al. | |
| 7,901,330 | B2 | 3/2011 | Dalebout et al. | |
| D703,278 | S | 4/2014 | Horita | |
| 8,734,298 | B2 | 5/2014 | Murray | |
| 8,926,478 | B2 | 1/2015 | Huang et al. | |
| 8,979,713 | B2 | 3/2015 | Huang et al. | |
| 9,056,217 | B2 | 6/2015 | Kao et al. | |
| 9,061,174 | B2 | 6/2015 | Jun | |
| 9,192,809 | B1 | 11/2015 | Miller et al. | |
| 9,254,414 | B2 | 2/2016 | Liu et al. | |
| 9,468,797 | B1 | 10/2016 | Miller | |
| 9,522,300 | B1 | 12/2016 | Miller | |
| 9,586,087 | B1 * | 3/2017 | Lin | A63B 22/0664 |
| D792,530 | S | 7/2017 | Hendricks | |
| 9,950,209 | B2 | 4/2018 | Yim | |
| 9,974,998 | B2 | 5/2018 | Miller | |
| 10,328,301 | B2 * | 6/2019 | Anderson | A63B 21/0051 |
| 2003/0096677 | A1 | 5/2003 | Chu | |
| 2005/0181911 | A1 | 8/2005 | Porth | |
| 2005/0181912 | A1 | 8/2005 | Eschenbach | |
| 2006/0079381 | A1 | 4/2006 | Cornejo et al. | |
| 2006/0166791 | A1 | 7/2006 | Liao et al. | |
| 2006/0172865 | A1 | 8/2006 | Dey et al. | |
| 2006/0293153 | A1 | 12/2006 | Porth et al. | |
| 2007/0087906 | A1 | 4/2007 | Rodgers, Jr. | |
| 2007/0117683 | A1 | 5/2007 | Ercanbrack et al. | |
| 2007/0129219 | A1 | 6/2007 | Mahleberg | |
| 2007/0232457 | A1 | 10/2007 | Porth | |
| 2007/0254778 | A1 | 11/2007 | Ashby | |
| 2008/0161163 | A1 | 7/2008 | Stewart et al. | |
| 2008/0207400 | A1 | 8/2008 | Liao Lai | |
| 2008/0220947 | A1 | 9/2008 | Meng | |
| 2008/0280731 | A1 | 11/2008 | Dalebout et al. | |
| 2009/0011904 | A1 | 1/2009 | Chuang et al. | |
| 2009/0048077 | A1 | 2/2009 | Chuang et al. | |
| 2009/0093346 | A1 | 4/2009 | Nelson et al. | |
| 2009/0124463 | A1 | 5/2009 | Chen | |
| 2009/0203501 | A1 | 8/2009 | Rodgers, Jr. | |
| 2009/0312156 | A1 | 12/2009 | Chen et al. | |
| 2010/0167877 | A1 | 7/2010 | Grind | |
| 2010/0190613 | A1 | 7/2010 | Murray et al. | |
| 2010/0234185 | A1 | 9/2010 | Watt et al. | |
| 2012/0088635 | A1 | 4/2012 | Lee et al. | |
| 2013/0012363 | A1 | 1/2013 | Eschenbach | |
| 2013/0085042 | A1 | 4/2013 | Huang | |
| 2013/0237379 | A1 * | 9/2013 | Huang | A63B 22/0015 482/52 |
| 2014/0194253 | A1 | 7/2014 | Huang et al. | |

(56) References Cited

U.S. PATENT DOCUMENTS

| | | | |
|---|---|---|---|
| 2014/0248998 | A1 | 9/2014 | Lu et al. |
| 2014/0274575 | A1 | 9/2014 | Yim et al. |
| 2015/0238809 | A1 | 8/2015 | Huang et al. |
| 2016/0008658 | A1 | 1/2016 | Yim et al. |
| 2016/0082308 | A1 | 3/2016 | Yim et al. |
| 2017/0056709 | A1 | 3/2017 | Ercanbrack et al. |
| 2017/0056717 | A1 | 3/2017 | Ercanbrack et al. |
| 2018/0304117 | A1 | 10/2018 | Yim et al. |
| 2018/0339189 | A1 | 11/2018 | Luger et al. |

FOREIGN PATENT DOCUMENTS

| | | | |
|---|---|---|---|
| EP | 0323056 | B1 | 3/1993 |
| EP | 2383020 | A1 | 11/2011 |
| WO | 2009026604 | A2 | 3/2009 |
| WO | 2014145981 | A1 | 9/2014 |

OTHER PUBLICATIONS

PCT International Search Report dated Aug. 20, 2014 for International Application No. PCT/US2014/030845, 2 pages.

PCT International Search Report and Written Opinion dated Nov. 18, 2014 for International Application No. PCT/US2014/031119, 18 pages.

PCT International Search Report and Written Opinion dated Oct. 14, 2014, Application No. PCT/US2014/030875, 13 pages.

PCT Written Opinion dated Aug. 20, 2014 for International Application No. PCT/US2014/030845, 7 pages.

PCT Application No. PCT/US2018/033925 dated Aug. 9, 2018, 12 pages.

Bowflex, "Bowflex Max Trainer M7", Youtube, https://www.youtube.com/watch?v=VaeRjre0RIM [Retrieved form the internet on Nov. 4, 2016], Feb. 5, 2016, 4 pages.

Office Action for CA Application No. 3,013,141, dated Oct. 6, 2020.

* cited by examiner

EXERCISE MACHINE

CROSS-REFERENCE TO RELATED APPLICATIONS

This application is a continuation of U.S. patent application Ser. No. 15/970,627, filed on May 3, 2018, entitled, "Exercise Machine", now issued as U.S. Pat. No. 10,252,101 which is a continuation of U.S. patent application Ser. No. 14/954,144, filed on Nov. 30, 2015, entitled "Exercise Machine", now issued as U.S. Pat. No. 9,987,513, which is a continuation of U.S. Patent application Ser. No. 14/218,808, filed on Mar. 18, 2014, entitled "Exercise Machine", now issued as U.S. Pat. No. 9,199,115, which is a continuation of PCT International Patent Application No. PCT/US2014/030875, filed on Mar. 17, 2014, entitled "Exercise Machine", which claims, under 35 U.S.C. § 119(e), the benefit of U.S. Provisional Patent Application No. 61/798,663, filed on Mar. 15, 2013, entitled "Exercise Machine", which applications are hereby incorporated by reference in their entireties.

TECHNICAL FIELD

This application concern stationary exercise machine having reciprocating member.

BACKGROUND

Traditional stationary exercise machine include stair climber-type machine and elliptical running-type machine. Each of these type of machine typically offer a different type of workout, with stair climber-type machine providing for a lower frequency vertical climbing simulation, and with elliptical machine providing for a higher frequency horizontal running simulation. Additionally, if these machine have handle that provide upper body exercise, the connection between the handles, the foot pedals/pads, and/or the flywheel mechanism provide an insufficient exercise experience for the upper body.

It is therefore desirable to provide an improved stationary exercise machine and, more specifically, an improved exercise machine that may address or improve upon the above-described stationary exercise machine and/or which more generally offer improvement or an alternative to existing arrangements.

SUMMARY

Described herein are embodiments of stationary exercise machine having reciprocating foot and/or hand members, such as foot pedals that move in a closed loop path. Some embodiments can include reciprocating foot pedals that cause a user's feet to move along a closed-loop path that is substantially inclined, such that the foot motion simulates a climbing motion more than a flat walking or running motion. Some embodiments can further include reciprocating handle that are configured to move in coordination with the foot via a linkage to a crank wheel also coupled to the foot pedal. Variable resistance can be provided via a rotating air-resistance based mechanism, via a magnetism based mechanism, and/or via other mechanisms, one or more of which can be rapidly adjustable while the user is using the machine.

Some embodiments of a stationary exercise machine comprise first and second reciprocating foot pedals each configured to move in a respective closed loop path, with each of the closed loop path defining a major axis extending between two point in the closed loop path that are furthest apart from each other, and wherein the major axis of the closed loop path is inclined more than 45° relative to a horizontal plane. The machine includes at least one resistance mechanism configured to provide resistance against motion of the foot pedals along their closed loop paths, with the resistance mechanism including an adjustable portion configured to change the magnitude of the resistance provided by the resistance mechanism at a given reciprocation frequency of the foot pedals, and such that the adjustable portion is configured to be readily adjusted by a user of the machine while the user is driving the foot pedal with his feet during exercise.

In some embodiments, the adjustable portion is configured to rapidly adjust between two predetermined resistance settings, such as in less than one second. In some embodiments, the resistance mechanism is configured to provide increased resistance as a function of increased reciprocation frequency of the foot pedals.

In some embodiments, the resistance mechanism includes an air-resistance based resistance mechanism wherein rotation of the air-resistance based resistance mechanism draw air into a lateral air inlet and expels the drawn in air through radial air outlets. The air-resistance based resistance mechanism can includes an adjustable air flow regulator that can be adjusted to change the volume of air flow through the air inlet or air outlet at a given rotational velocity of the air-resistance based resistance mechanism. The adjustable air flow regulator can includes a rotatable plate positioned at a lateral side of the air-resistance based resistance mechanism and configured to rotate to change a cross-flow area of the air inlet, or the adjustable air flow regulator can includes a axially movable plate positioned at a lateral side of the air-resistance based resistance mechanism and configured to move axially to change the volume of air entering the air inlet. The adjustable air flow regulator can be configured to be controlled by an input of a user remote from the air-resistance based resistance mechanism while the user is driving the foot pedals with his feet.

In some embodiments, the resistance mechanism includes a magnetic resistance mechanism that includes a rotatable rotor and a brake caliper, the brake caliper including magnet configured to induce an eddy current in the rotor as the rotor rotate between the magnets, which cause resistance to the rotation of the rotor. The brake caliper can be adjustable to move the magnets to different radial distance away from an axis of rotation of the rotor, such that increasing the radial distance of the magnets from the axis increases the amount of resistance the magnets apply to the rotation of the rotor. The adjustable brake caliper can be configured to be controlled by an input of a user remote from the magnetic resistance mechanism while the user is driving the foot pedals with his feet. Some embodiments of a stationary exercise machine includes a stationary frame, first and second reciprocating foot pedals coupled to the frame with each foot pedals configured to move in a respective closed loop path relative to the frame, a crank wheel rotatably mounted to the frame about a crank axis with the foot pedals being coupled to the crank wheel such that reciprocation of the foot pedals about the closed loop paths drive the rotation of the crank wheel, at least one handle pivotably coupled to the frame about a first axis and configured to be driven by a user's hand, wherein the first axis is substantially parallel to and fixed relative to the crank axis. The machine further includes a first linkage fixed relative to the handle and pivotable about the first axis and having a radial end extending opposite the first axis, a second linkage having a first end pivotally coupled to the radial end of the first linkage about a second axis that is substantially parallel to the crank axis, a third linkage that is rotatably coupled to a second end of the second linkage about a third axis that is substantially parallel to the crank axis, wherein the third linkage is fixed relative to the crank wheel and rotatable about the crank axis. The machine is configured such that pivoting motion of the handle is synchronized with motion of one of the foot pedals along it closed loop path.

In some embodiments, the second end of the second linkage includes an annular collar and the third linkage includes a circular disk that is rotatably mounted within the annular collar.

In some embodiments, the third axis passes through the center of the circular disk and the crank axis passes through the circular disk at a location off set from the center of the circular disk but within the annular collar.

In some embodiments, the frame can include inclined members having non-linear portion configured to cause intermediate portions of the lower reciprocating member to move in non-linear paths, such as by causing rollers attached to the intermediate portion of the foot members to roll along the non-linear portions of the inclined members.

The foregoing and other objects, features, and advantages of the invention will become more apparent from the following detailed description, which proceed with reference to the accompanying figures.

DETAILED DESCRIPTION

Figure 1:
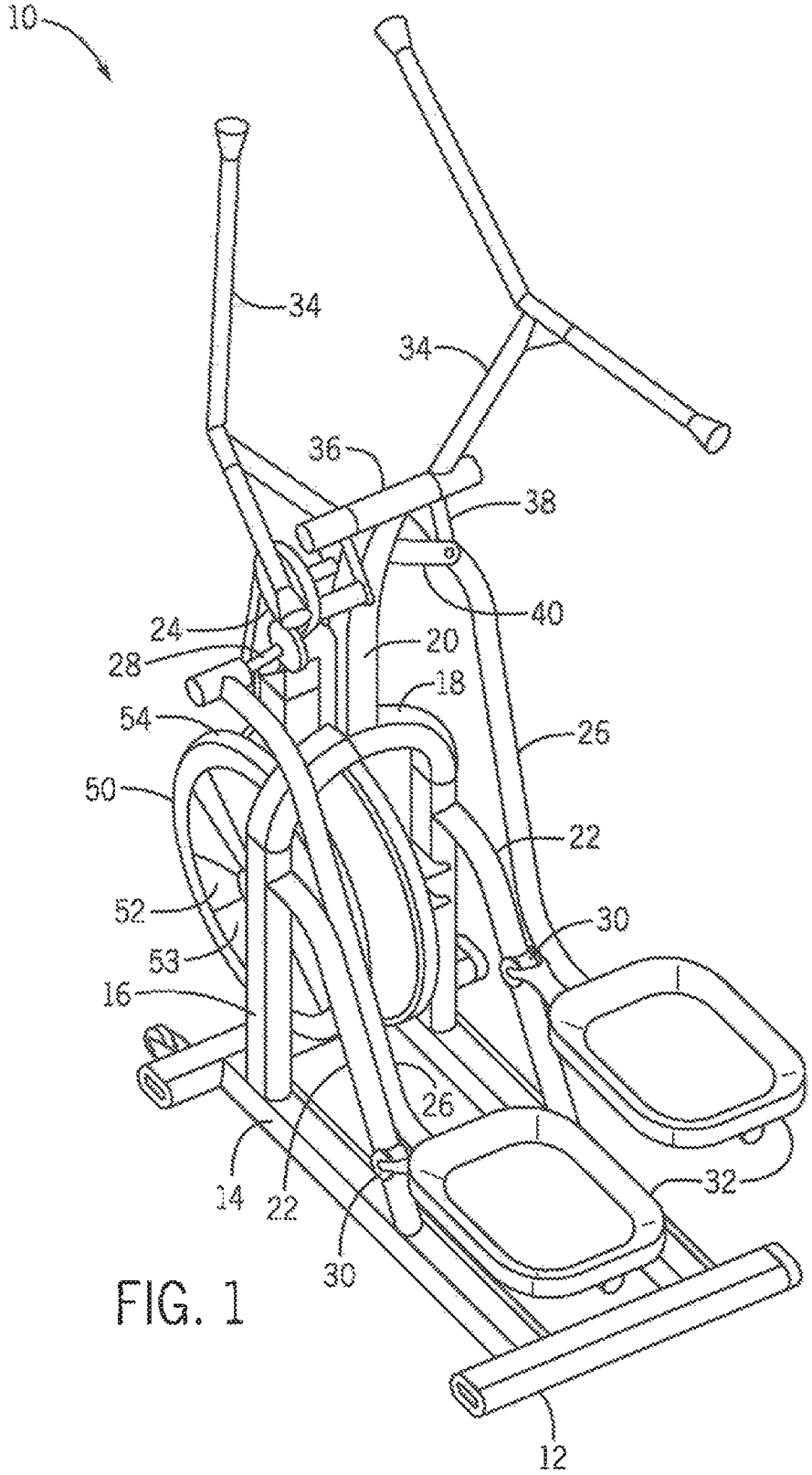
FIG. 1 is a perspective view of an exemplary exercise machine.
Figure 2B:
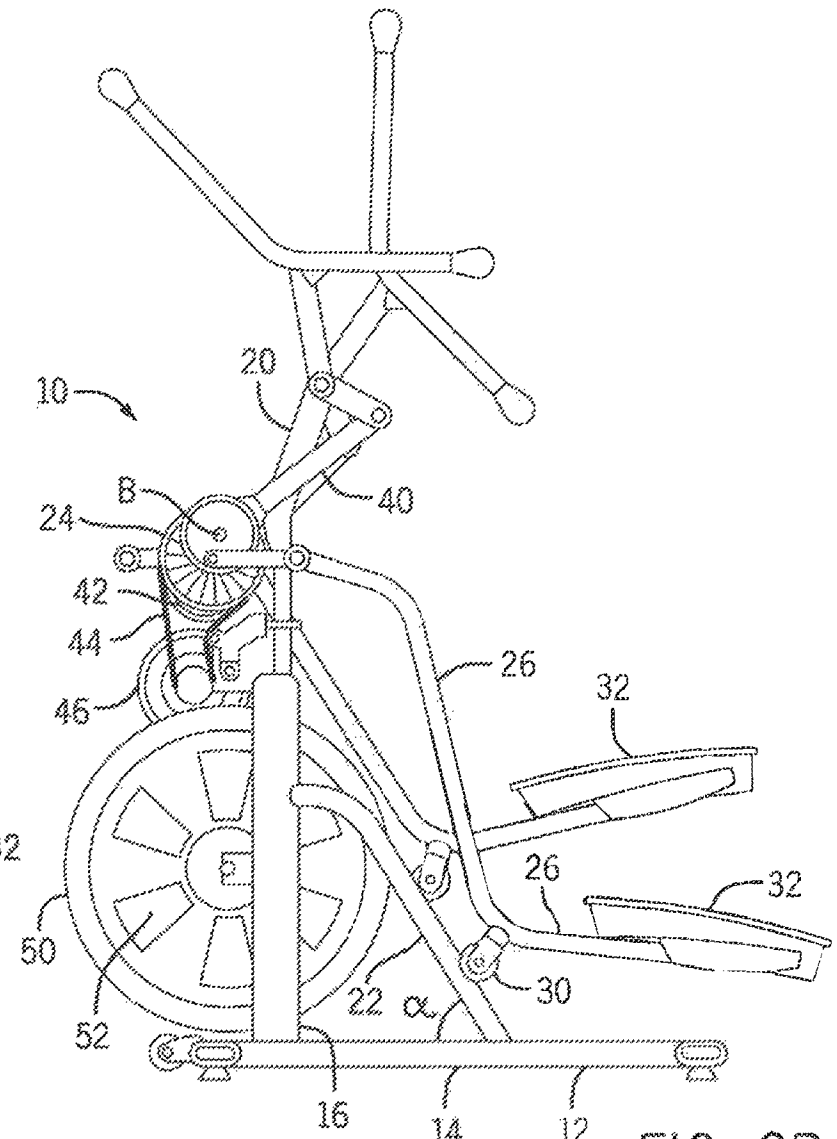
FIGS. 2A-2D are left side view of the machine of FIG. 1, showing different stages of a crank cycle.
Figure 2A:
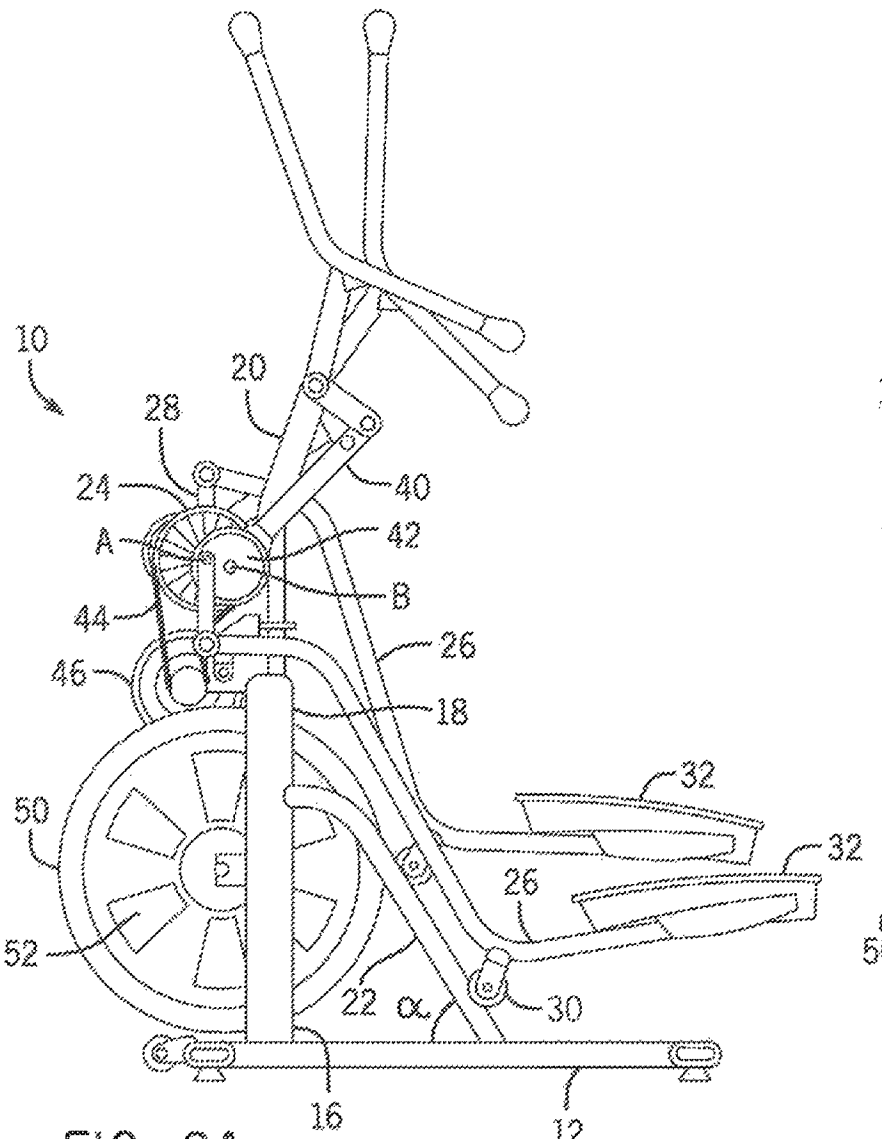
Figure 2D:
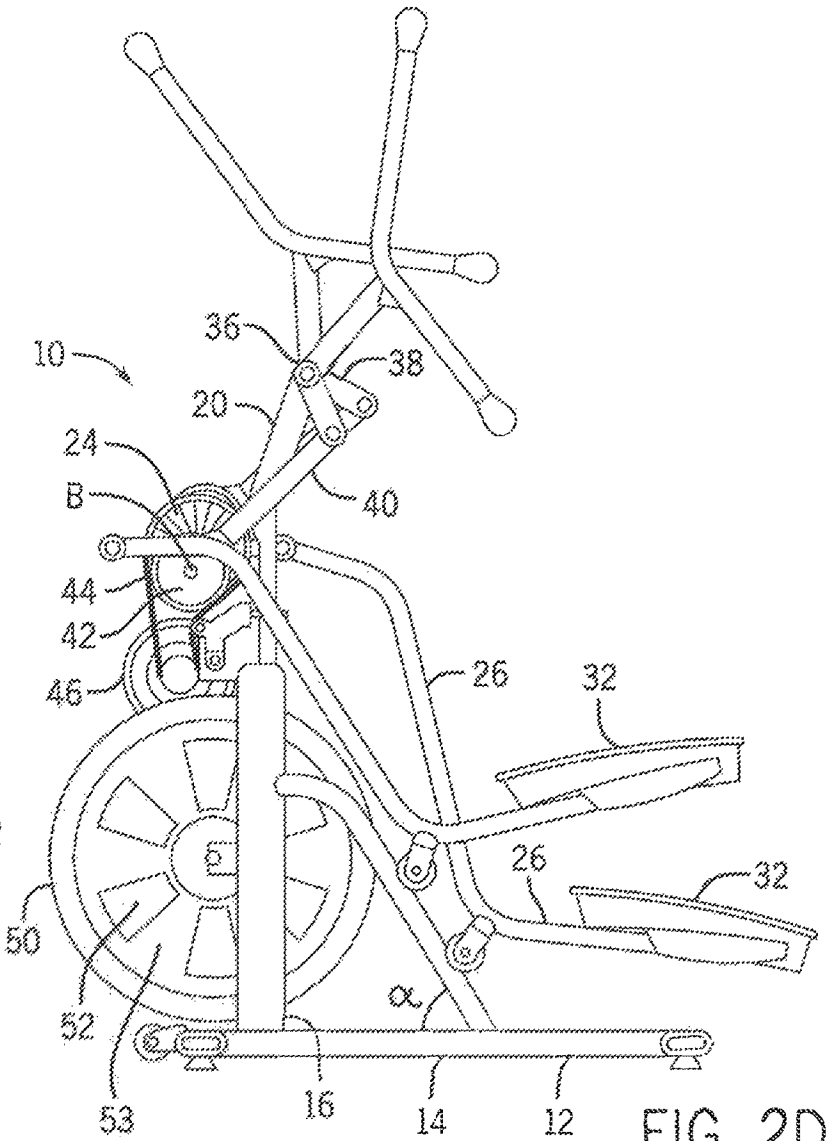
Figure 2C:
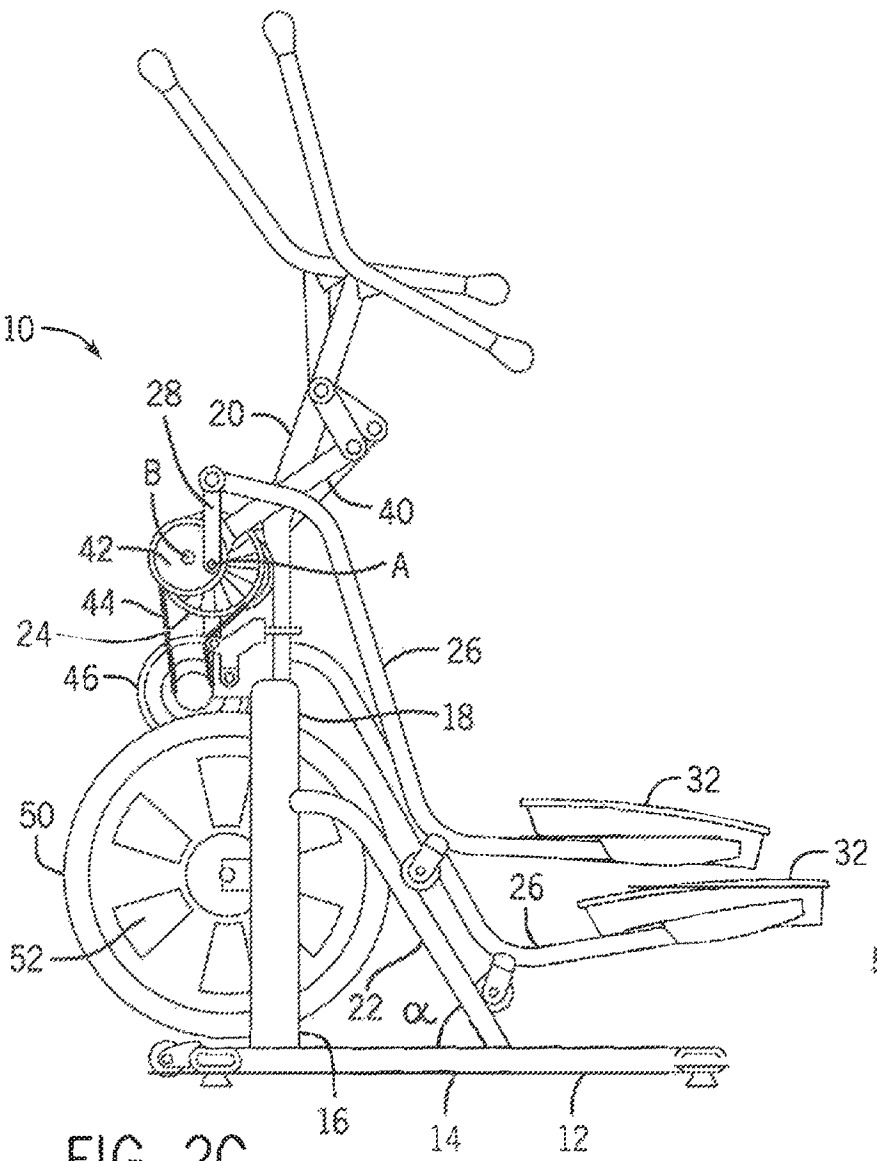
Figure 3:
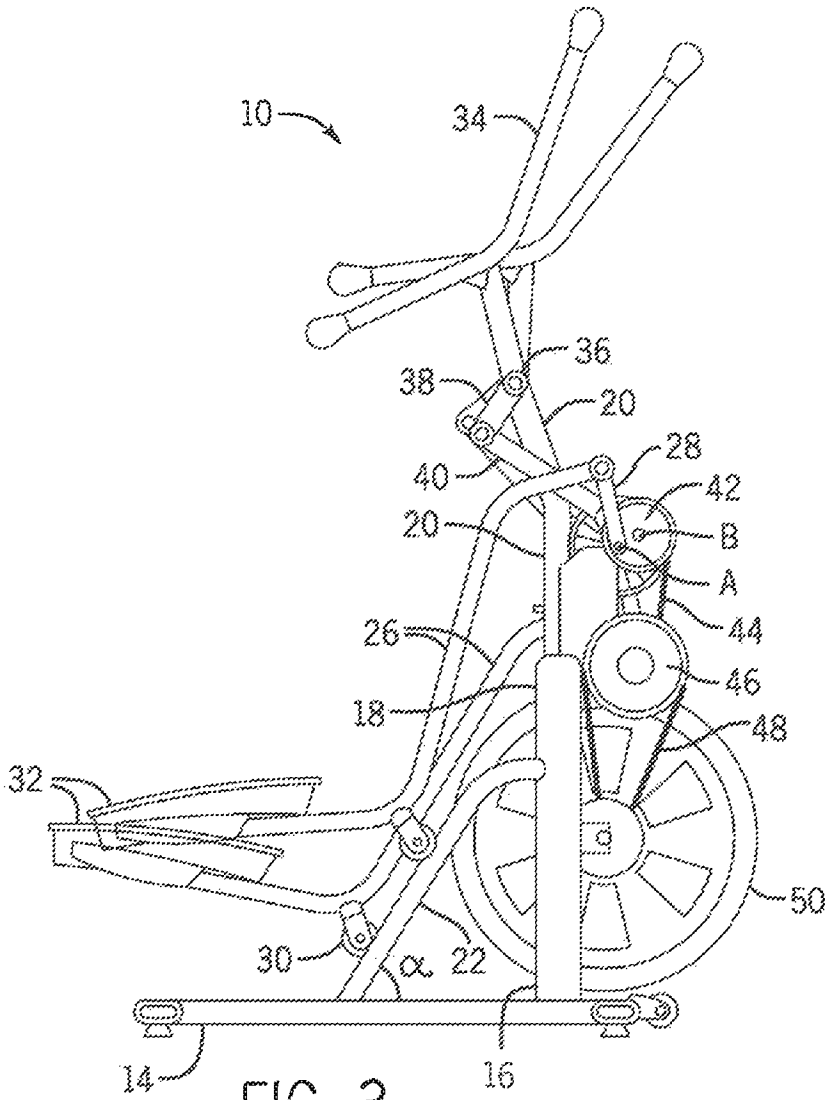
FIG. 3 is a right side view of the machine of FIG. 1.

Described herein are embodiments of stationary exercise machine having reciprocating foot and/or hand members, such as foot pedals that move in a closed loop path. The disclosed machines can provide variable resistance against the reciprocal motion of a user, such as to provide for variable-intensity interval training. Some embodiments can include reciprocating foot pedals that cause a user's feet to move along a closed loop path that is substantially inclined, such that the foot motion simulate a climbing motion more than a flat walking or running motion. Some embodiments can further include upper reciprocating member that are configured to move in coordination with the foot pedals and allow the user to exercise upper body muscles. The resistance to the hand members may be proportional to the resistance to the foot pedals. Variable resistance can be provided via a rotating air-resistance based fan-like mechanism, via a magnetism based eddy current mechanism, via friction based brakes, and/or via other mechanisms, one or more of which can be rapidly adjusted while the user is using the machine to provide variable intensity interval training.

FIG. 1-7A how an exemplary embodiment of an exercise machine 10. The machine 10 may include a frame 12 having a base 14 for contact with a support surface, first and second vertical braces 16 coupled by an arched brace 18, an upper support structure 20 extending above the arched brace 18, and first and second inclined members 22 that extend between the base 14 and the first and second vertical braces 16, respectively.

Figure 4:
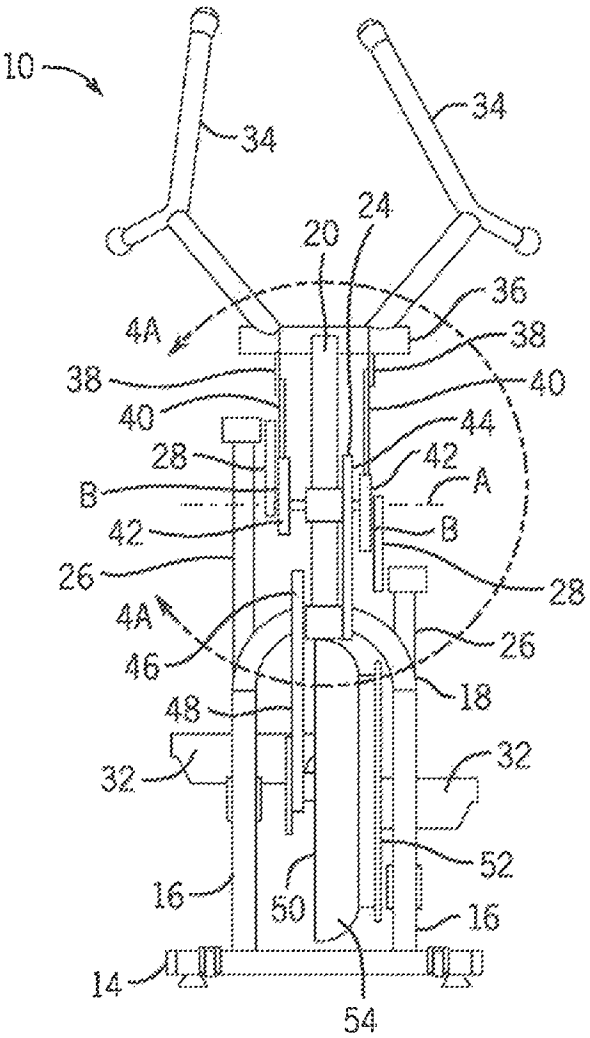
FIG. 4 is a front view of the machine of FIG. 1.
Figure 4A:
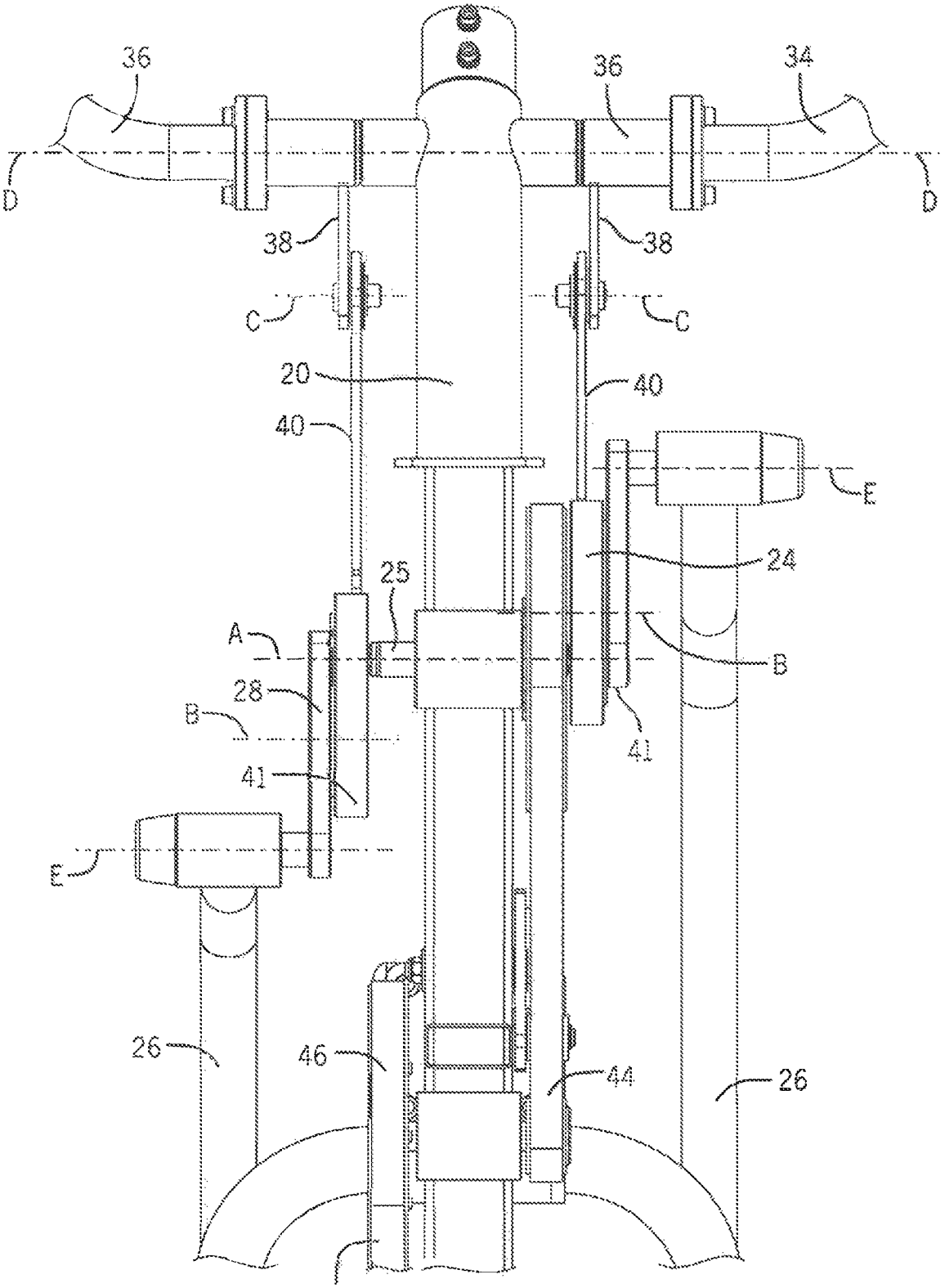
FIG. 4A is an enlarged view of a portion of FIG. 4.
Figure 6:
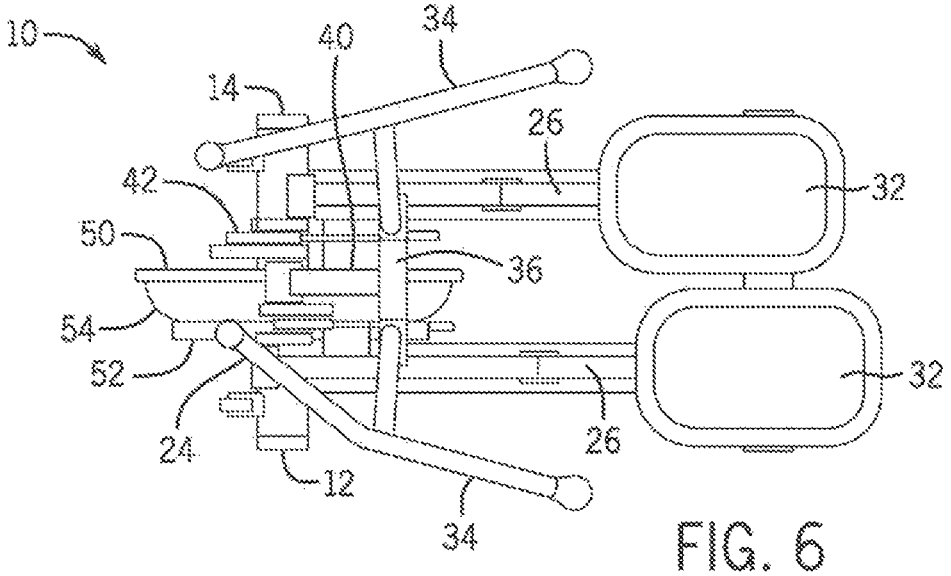
FIG. 6 is a top view of the machine of FIG. 1.

A crank wheel 24 is fixed to a crank shaft 25 (see FIGS. 4A and 5A) that is rotatably supported by the upper support structure 20 and rotatable about a fixed horizontal crank axis A. First and second crank arms 28 are fixed relative to the crank wheel 24 and crank shaft 25 and positioned on either side of the crank wheel and also rotatable about the crank axis A, such that rotation of the crank arm 28 causes the crank shaft 25 and the crank wheel 24 to rotate about the crank axis A. (Each of the left half and right half of the exercise machine 10 may have similar or identical components, and as discussed herein these similar or identical component may be utilized with the same callout number although opposing component are represented. E.g. crank arms 28 may be located on each side of the machine 10 as illustrated in FIG. 4A). The first and second crank arms 28 have respective first end fixed to the crank shaft 25 at the crank axis A and second ends that are distal from the first end. The first crank arm 28 extends from its first end to its second end in a radial direction that is opposite the radial direction that the second crank arms extend from its first end and its second end. First and second lower reciprocating members 26 have forward ends that are pivotably coupled to the second end of the first and second crank arms 28, respectively, and rearward ends that are coupled to first and second foot pedals 32, respectively. First and second rollers 30 are coupled to intermediate portions of the first and second lower reciprocating members 26, respectively, such that the roller 30 can rollingly translate along the inclined members 22 of the frame 12. In alternative embodiments, other bearing mechanism can be used to facilitate translational motion of the lower reciprocating members 26 along the inclined members 22 instead of or in addition to the rollers 30, such as sliding friction-type bearings.

Figure 17:
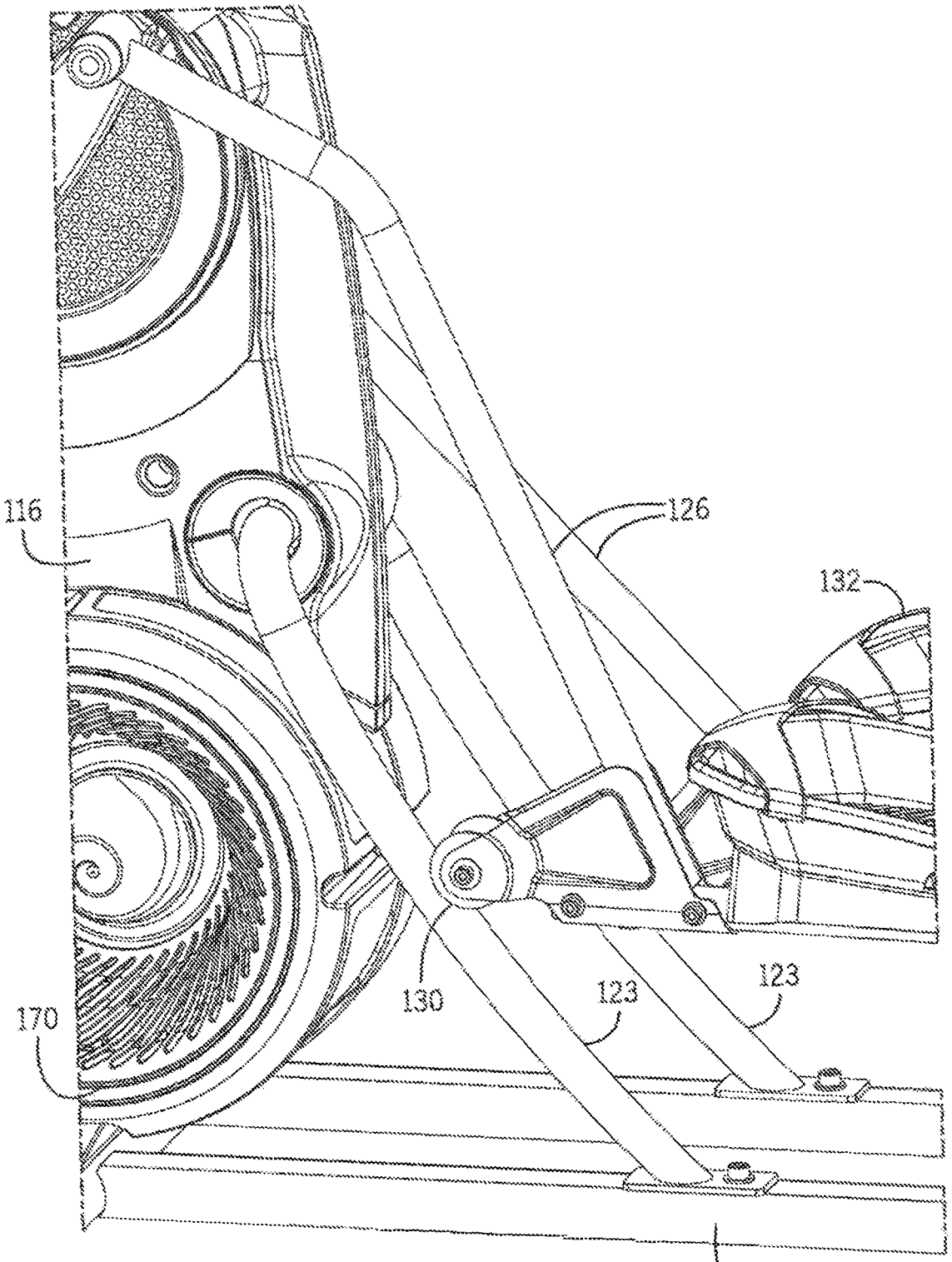
FIG. 17 is a partial side view of an exemplary exercise machine having curved inclined members taken from FIG. 14.
Figure 18A:
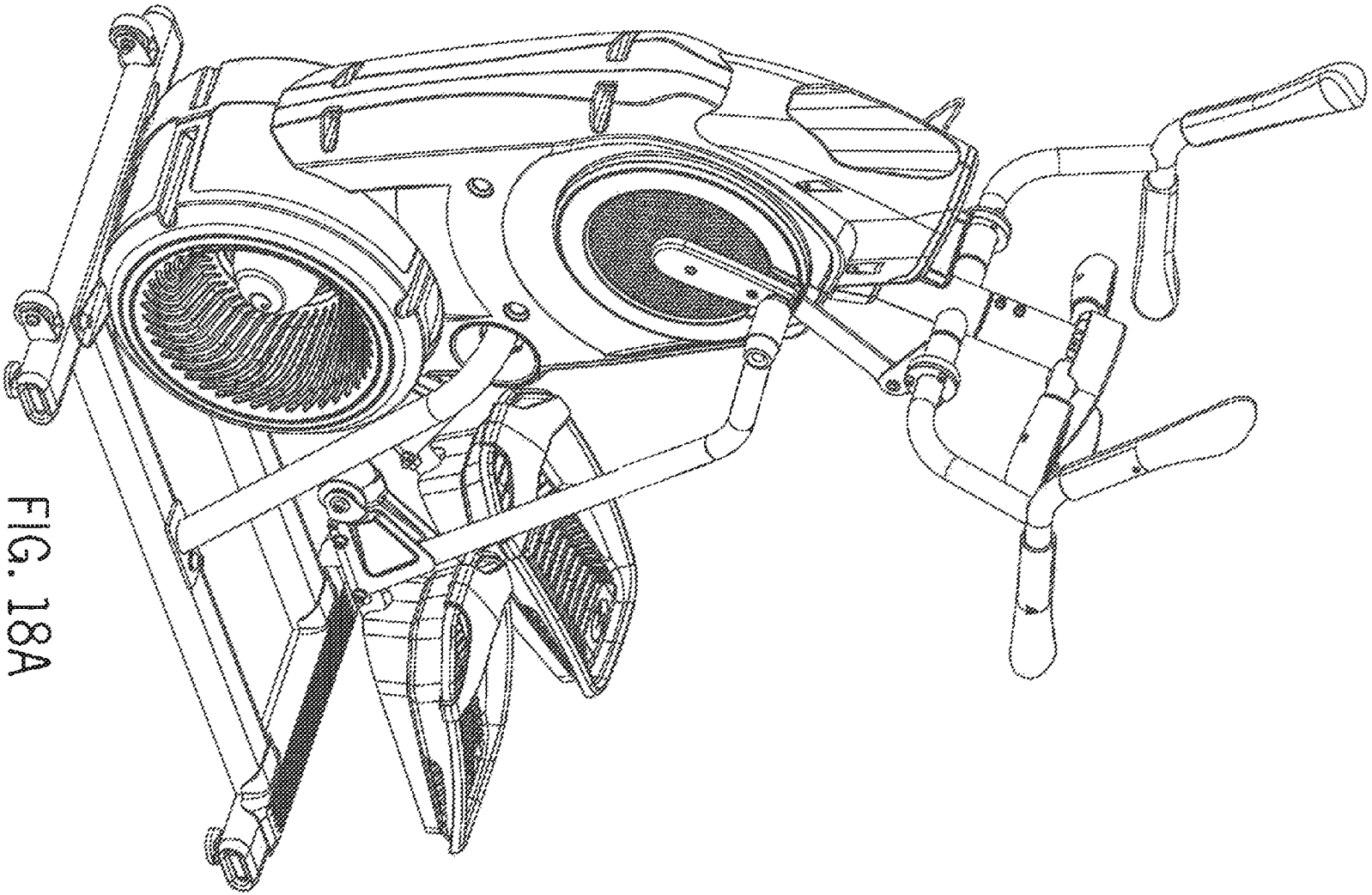
FIGS. 18A-G are isometric, front, back, left, right, top, and bottom views of an exemplary exercise machine.
Figure 18B:
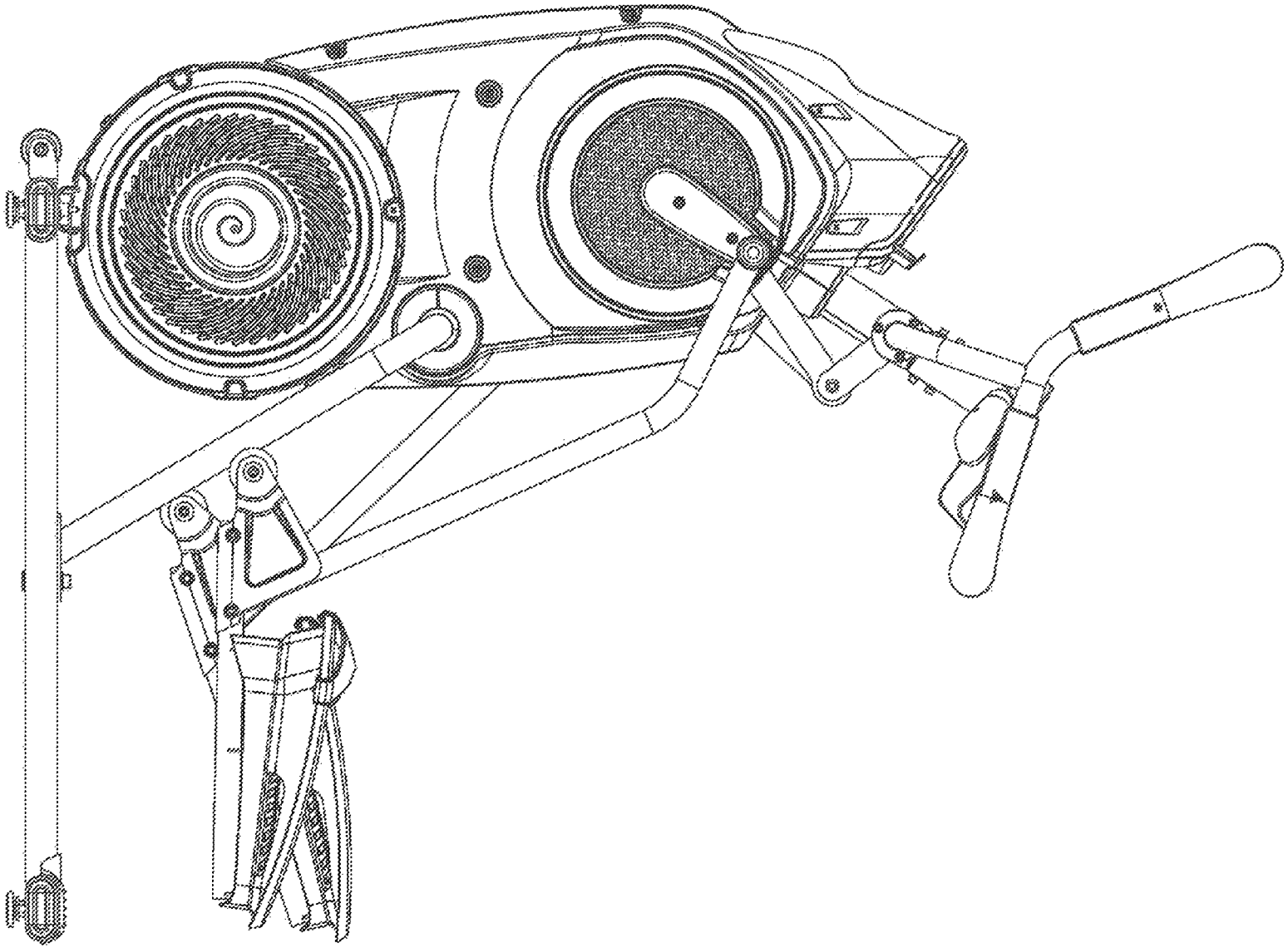
Figure 18C:
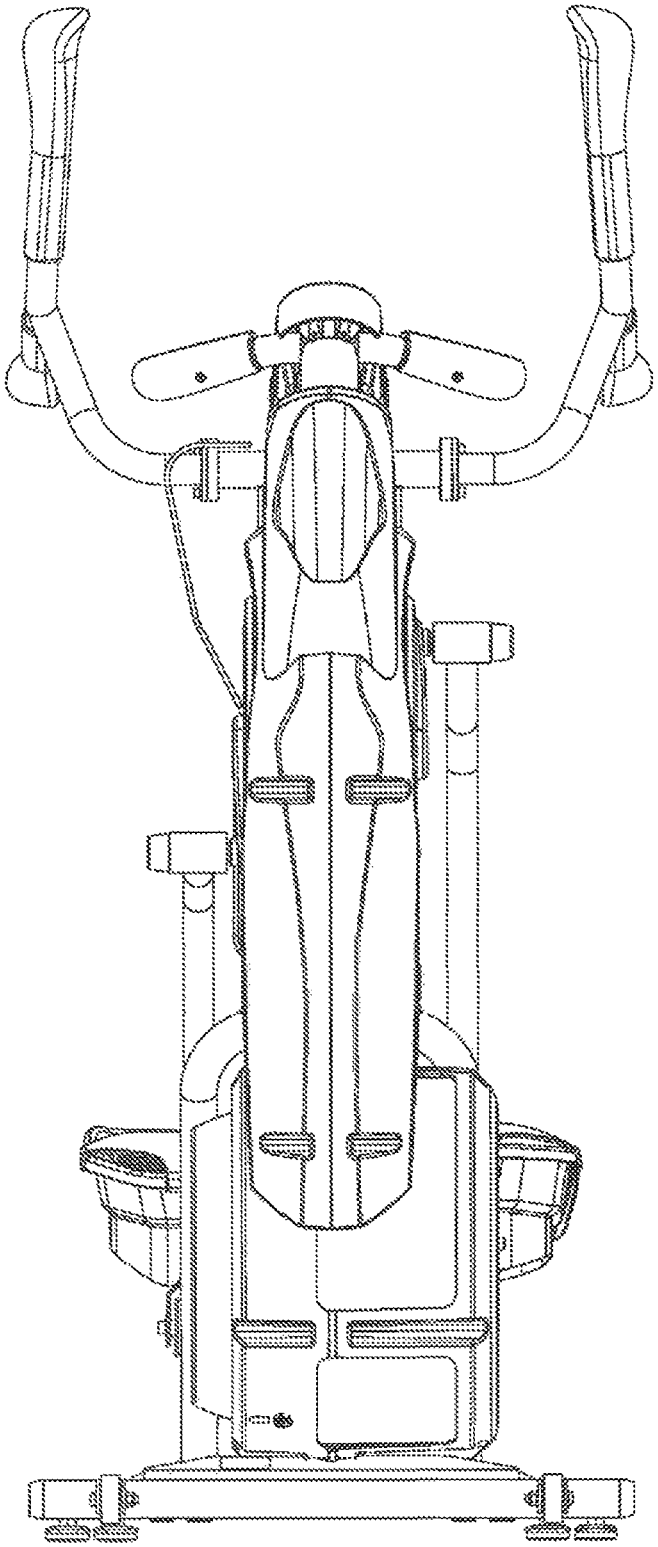
Figure 18D:
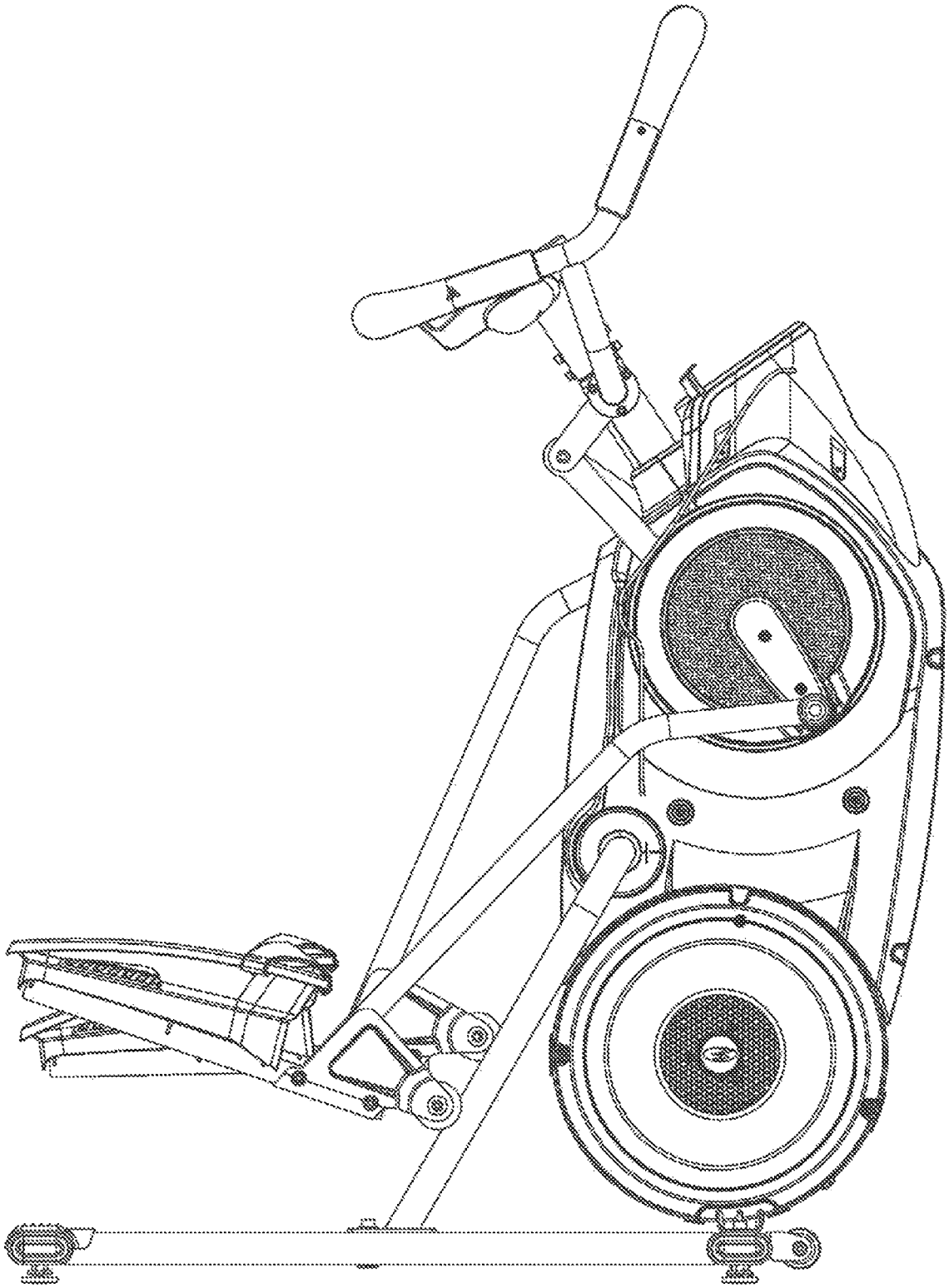
Figure 18E:
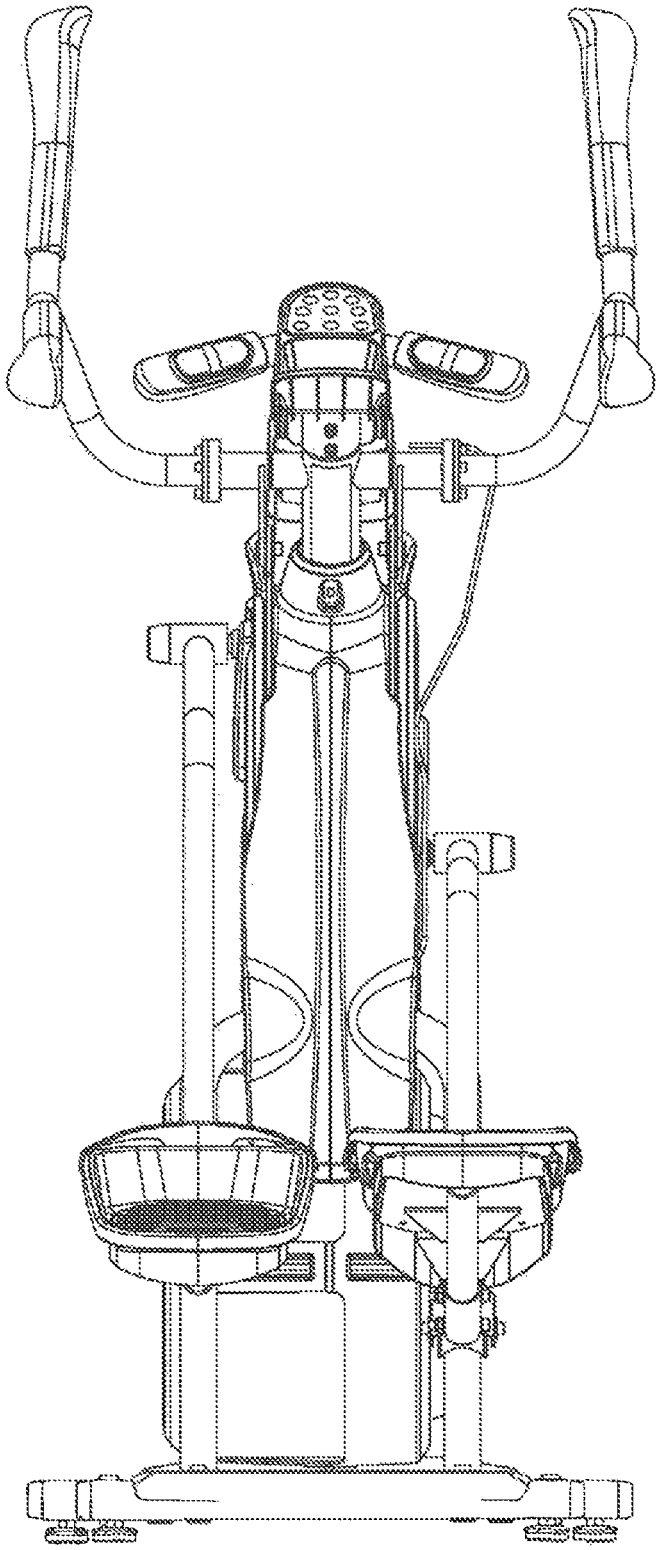
Figure 18F:
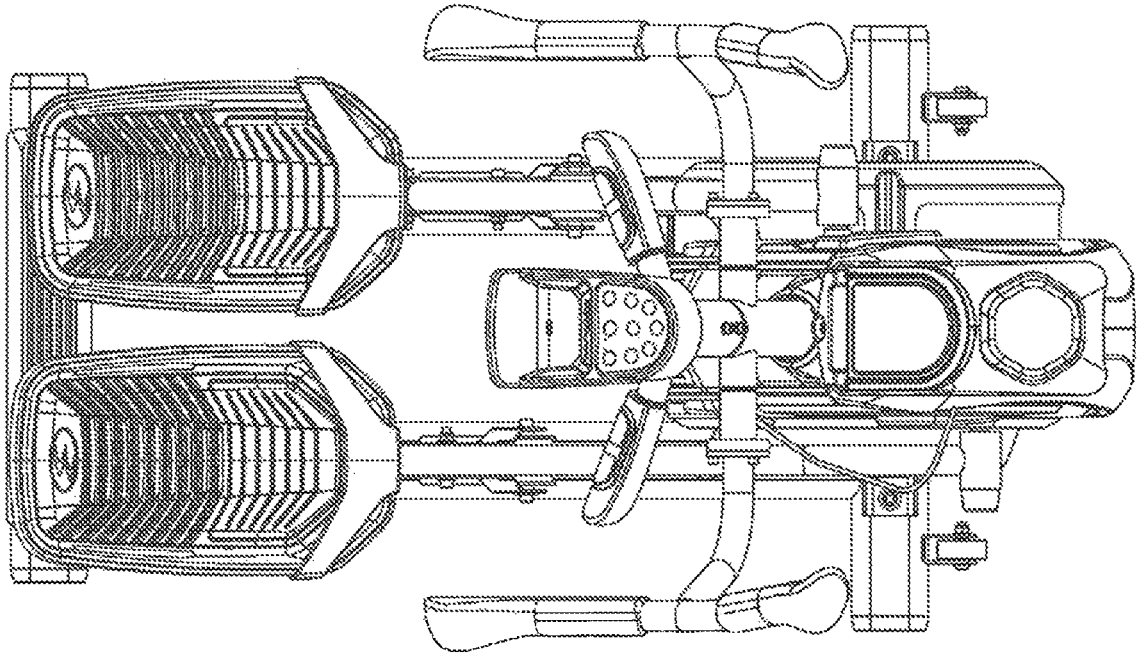
Figure 18G:
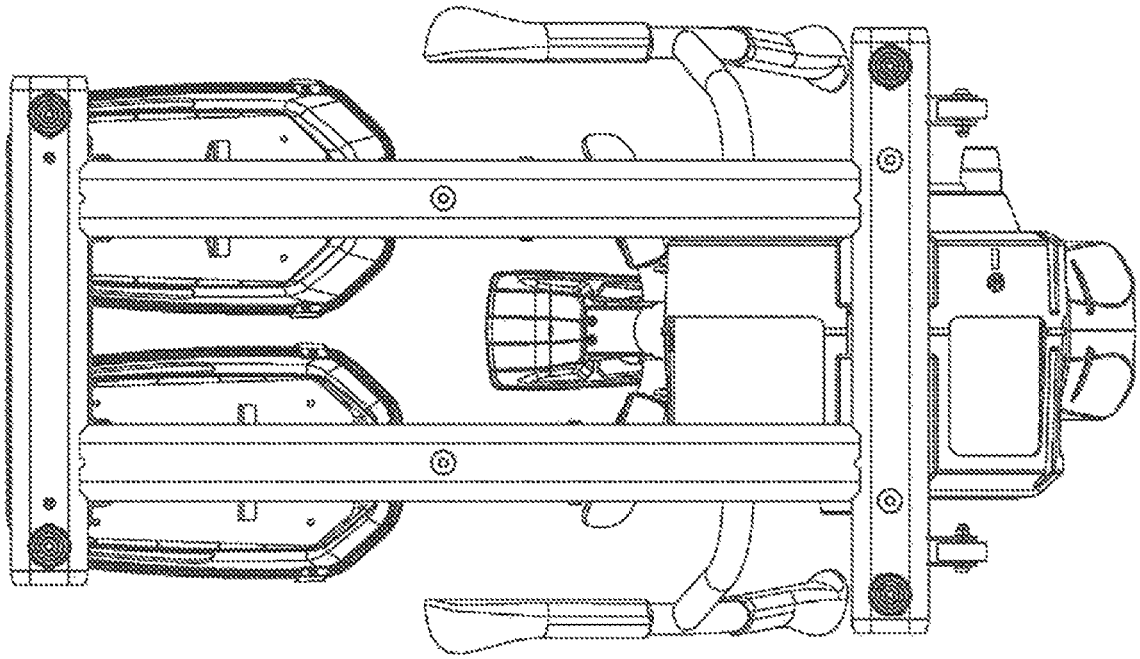

When the foot pedals 32 are driven by a user, the intermediate portions of the lower reciprocating members 26 translate in a substantially linear path via the rollers 30 along the inclined members 22. In alternative embodiments, the inclined members 22 can include a non-linear portion, such as a curved or bowed portion (e.g., see the curved inclined member 123 in FIG. 17), such that intermediate portions of the lower reciprocating members 26 translate in non-linear path via the rollers 30 along the non-linear portion of the inclined member 22. The non-linear portion of the inclined members 22 can have any curvature, such as a constant or non-constant radius of curvature, and can present convex, concave, and/or partially linear surfaces for the rollers 30 to travel along. In some embodiments, the non-linear portion of the inclined members 22 can have an average angle of inclination of at least 45°, and/or can have a minimum angle of inclination of at least 45°, relative to a horizontal ground plane.

The front ends of the lower reciprocating members 26 can move in circular path about the rotation axis A, which circular motion drives the crank arms 28 and the crank wheel 24 in a rotational motion. The combination of the circular motion of the forward ends of the lower reciprocating members 26 and the linear or non-linear motion of the intermediate portions of the foot members causes the pedal 32 at the rearward ends of the lower reciprocating members 26 to move in non-circular closed loop path, such as substantially ovular and/or substantially elliptical closed loop paths. For example, with reference to FIG. 7A, a point F at the front of the pedals 32 can traverse a path 60 and a point R at the rear of the pedals can traverse a path 62. The closed loop paths traversed by different points on the foot pedals 32 can have different shape and sizes, such as with the more rearward portion of the pedals 32 traversing longer distances. For example, the path 60 can be shorter and/or narrower than the path 62. A closed loop path traversed by the foot pedals 32 can have a major axis defined by the two point of the path that are furthest apart. The major axis of one or more of the closed loop path traversed by the pedal 32 can have an angle of inclination closer to vertical than to horizontal, such as at least 45°, at least 50°, at least 55°, at least 60°, at least 65°, at least 70°, at least 75°, at least 80°, and/or at least 85°, relative to a horizontal plane defined by the base 14. To cause such inclination of the closed loop path of the pedals, the inclined members can include a substantially linear or non-linear portion (e.g., see inclined members 123 in FIG. 17) over which the rollers 30 traverse that forms a large angle of inclination a, an average angle of inclination, and/or a minimum angle of inclination, relative to the horizontal base 14, such as at least 45°, at least 50°, at least 55°, at least 60°, at least 65°, at least 70°, at least 75°, at least 80°, and/or at least 85°. This large angle of inclination of the foot pedals motion can provide a user with a lower body exercise more akin to climbing than to walking or running on a level surface. Such a lower body exercise can be similar to that provided by a traditional stair climbing machine.

Figure 5:
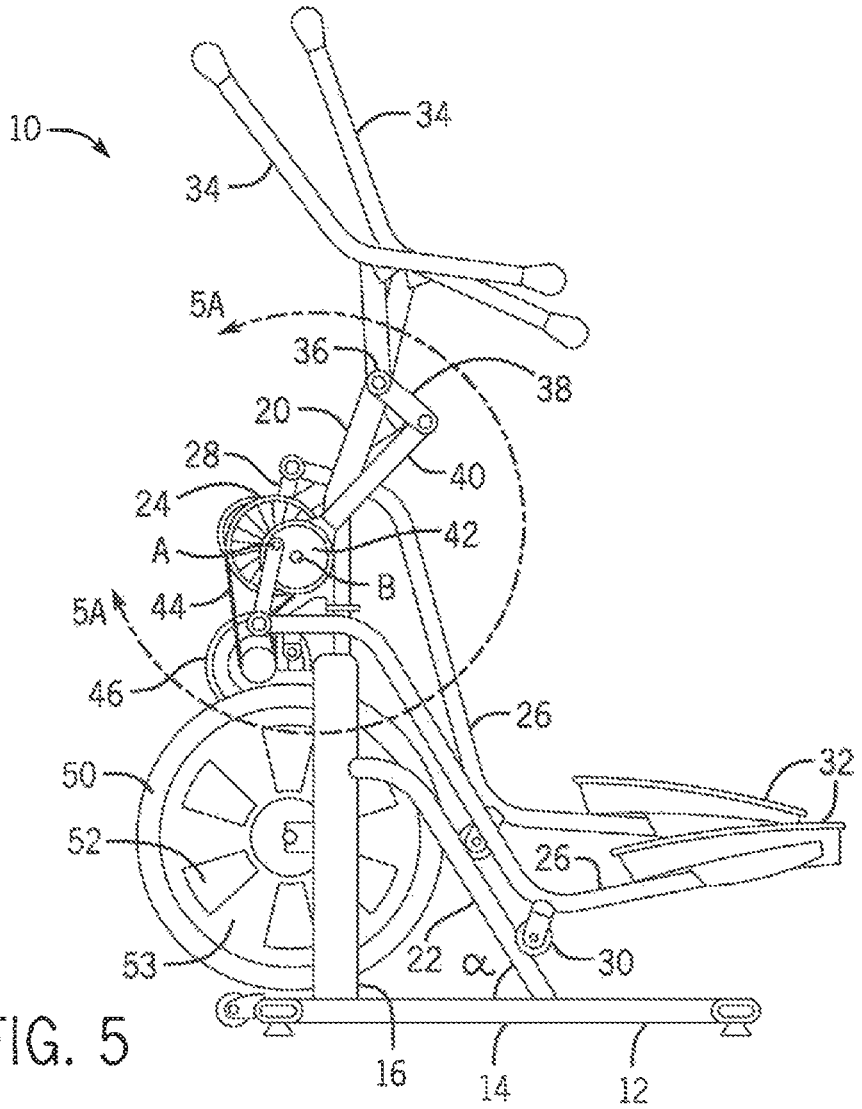
FIG. 5 is a left side view of the machine of FIG. 1.
Figure 5A:
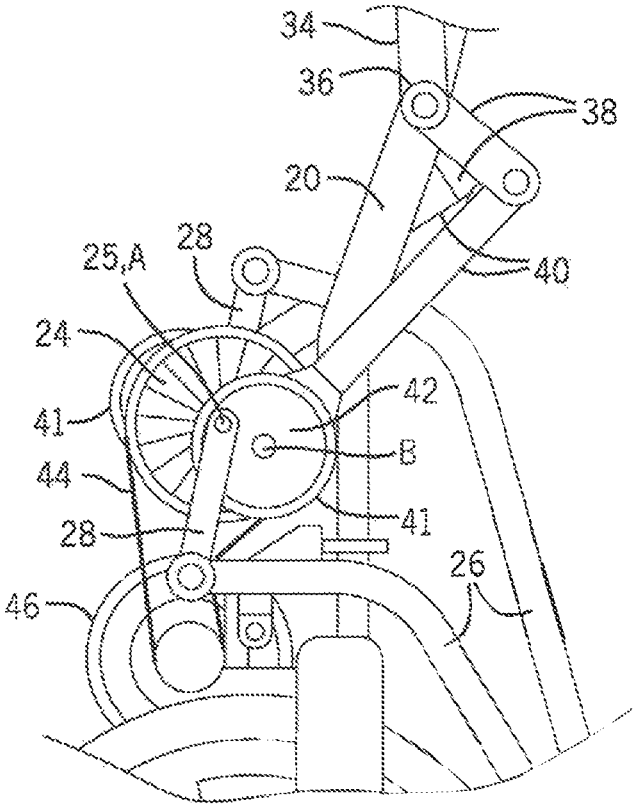
FIG. 5A is an enlarged view of a portion of FIG. 5.
Figure 7A:
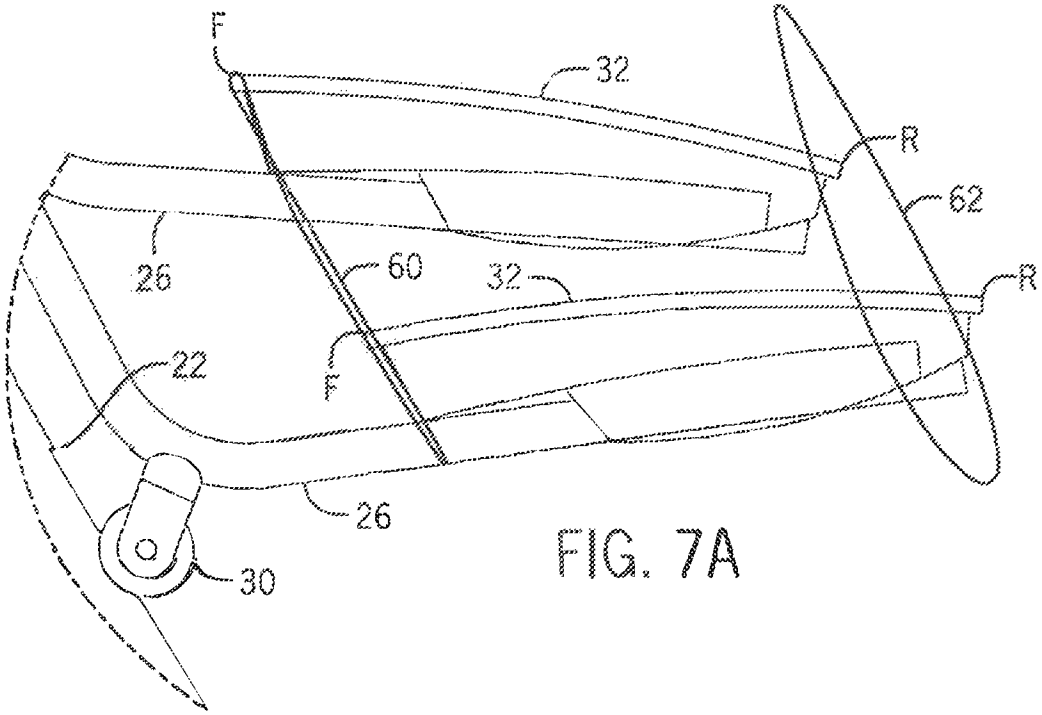
FIG. 7A is an enlarged view of a portion of FIG. 7, showing closed loop paths traversed by foot pedals of the machine.
Figure 7:
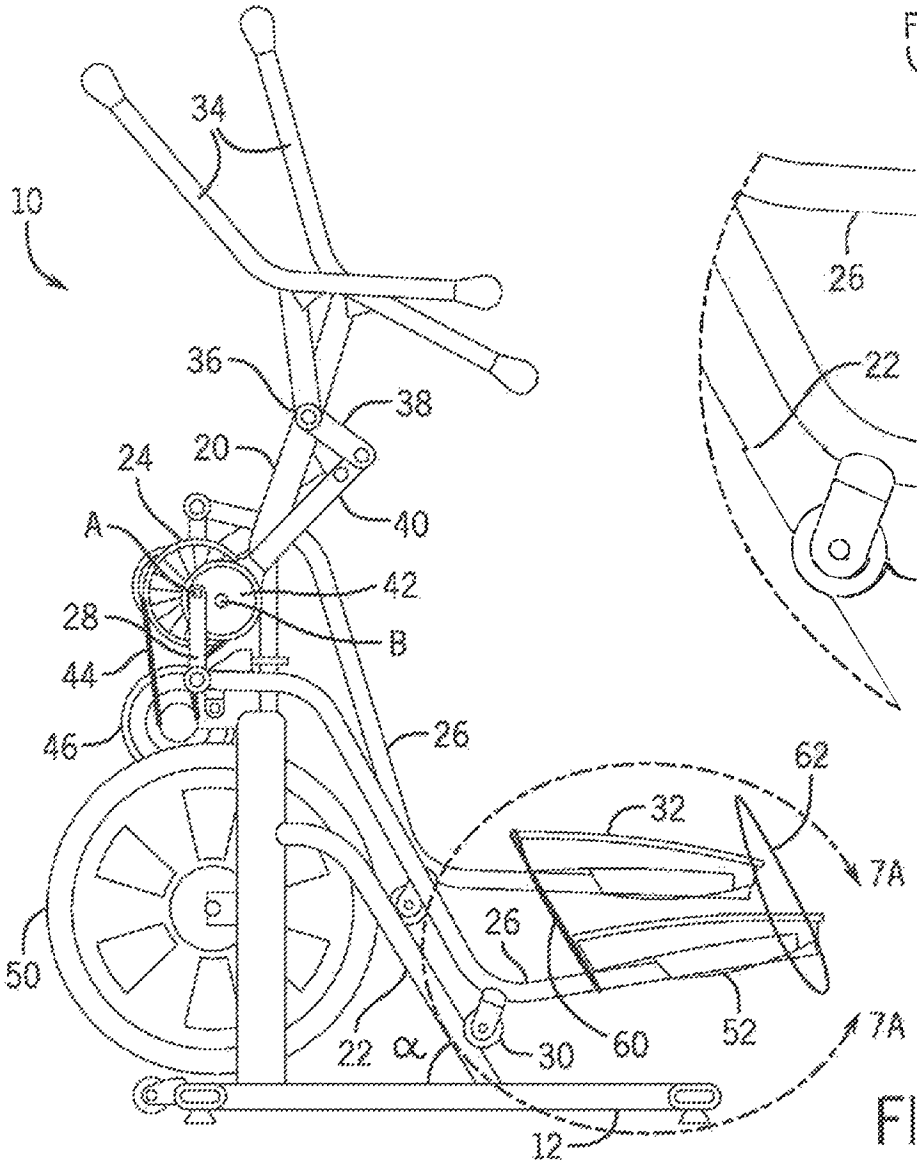
FIG. 7 is a left side view of the machine of FIG. 1.

The machine 10 can also include first and second handles 34 pivotally coupled to the upper support structure 20 of the frame 12 at a horizontal axis D. Rotation of the handles 34 about the horizontal axis D cause corresponding rotation of the first and second links 38, which are pivotably coupled at their radial ends to first and second upper reciprocating members 40. As shown in FIGS. 4A and 5A, for example, the lower ends of the upper reciprocating member 40 may include respective annular collars 41. A respective circular disk 42 is rotatably mounted within each of the annular collar 41, such that the disks 42 are rotatable relative to the upper reciprocating members 40 and each of the disk's 43 respective collar 41 about respective disk axes B at the center of each of the disks. The disk axe B are parallel to the fixed crank axis A and off set radially in opposite direction from the fixed crank axis A (see FIGS. 4A and 5A). As the crank wheel 24 rotate about the crank axis A, the disk axe B move in opposite circular orbit about the axis A of the same radius. The disk 42 are also fixed to the crank shaft 25 at the crank axis A, such that the disks 42 rotate within the respective annular collars 41 as the disks 42 pivot about the crank axis A on opposite side of the crank wheel 24. The disks 42 can be fixed relative to the respective crank arms 28, such that they rotate in unison around the crank axis A to crank the crank wheel 24 when the pedal 32 and/or the handle 34 are driven by a user. The handle linkage assembly may include the handle 34, the pivot axis 36, the link 38, the upper reciprocating members 40, and the disks 42. The components may be configured to cause the handles 34 to reciprocate in an opposite motion relative to the pedals 32. For example, as the left pedal 32 is moving upward and forward, the left handle 34 pivots rearward, and vice versa.

The crank wheel 24 can be coupled to one or more resistance mechanism to provide resistance to the reciprocation motion of the pedals 32 and handle 34. For example, the one or more resistance mechanism can include an air-resistance based resistance mechanism 50, a magnetism based resistance mechanism, a friction based resistance mechanism, and/or other resistance mechanisms. One or more of the resistance mechanism can be adjustable to provide different level of resistance. Further, one or more of the resistance mechanism can provide a variable resistance that corresponds to the reciprocation frequency of the exercise machine, such that resistance increases as reciprocation frequency increases.

With reference to FIGS. 1-7, the machines 10 may include an air-resistance based resistance mechanism, such as an air brake 50 that is rotationally mounted to the frame 12. The air brake 50 is driven by the rotation of the crank wheel 24. In the illustrated embodiment, the air brake 50 is driven by a belt or chain 48 that is coupled to a pulley 46, which is further coupled to the crank wheel 24 by another belt or chain 44 that extend around the perimeter of the crank wheel. The pulley 46 can be used as a gearing mechanism to adjust the ratio of the angular velocity of the air brake to the angular velocity of the crank wheel 24. For example, one rotation of the crank wheel 24 can cause several rotations of the air brake 50 to increases the resistance provided by the air brake.

The air brake 50 may include a radial fin structure that cause air to flow through the air brake when it rotates. For example, rotation of the air brake can cause air to enter through lateral openings 52 on the lateral side of the air brake near the rotation axis and exit through radial outlets 54 (see FIGS. 4 and 5). The induced air motion through the air brake 50 causes resistance to the rotation of the crank wheel 24 or other rotating components, which is transferred to resistance to the reciprocation motions of the pedal 32 and handles 34. As the angular velocity of the air brake 50 increases, the resistance force increase in a non-linear relationship, such as a substantially exponential relationship.

In some embodiments, the air brake 50 can be adjustable to control the volume of air flow that is induced to flow through the air brake at a given angular velocity. For example, in some embodiments, the air brake 50 can include a rotationally adjustable inlet plate 53 (see FIG. 5) that can be rotated relative to the air inlets 52 to change the total cross-flow area of the air inlets 52. The inlet plate 53 can have a range of adjustable positions, including a closed position where the inlet plate 53 blocks substantially the entire cross-flow area of the air inlets 52, such that there is no substantial air flow through the fan.

In some embodiment (not shown), an air brake can include an inlet plate that is adjustable in an axial direction (and optionally also in a rotational direction like the inlet plate 53). An axially adjustable inlet plate can be configured to move in a direction parallel to the rotation axis of the air brake. For example, when the inlet plate is further away axially from the air inlet( ) increased air flow volume is permitted, and when the inlet plate is closer axially to the air inlet( ) decreased air flow volume is permitted.

In some embodiment (not shown), an air brake can include an air outlet regulation mechanism that is configured to change the total cross-flow area of the air outlet 54 at the radial perimeter of the air brake, in order to adjust the air flow volume induced through the air brake at a given angular velocity.

In some embodiments, the air brake 50 can include an adjustable air flow regulation mechanism, such as the inlet plate 53 or other mechanism described herein, that can be adjusted rapidly while the machine 10 is being used for exercise. For example, the air brake 50 can include an adjustable air flow regulation mechanism that can be rapidly adjusted by the user while the user is driving the rotation of the air brake, such as by manipulating a manual lever, a button, or other mechanism positioned within reach of the user's hand while the user is driving the pedal 32 with his feet. Such a mechanism can be mechanically and/or electrically coupled to the air flow regulation mechanism to cause an adjustment of air flow and thus adjust the resistance level. In some embodiments, such as user-caused adjustment can be automated, such as using a button on a console near the handle 34 coupled to a controller and an electrical motor coupled to the air flow regulation mechanism. In other embodiments, such an adjustment mechanism can be entirely manually operated, or a combination of manual and automated. In some embodiments, a user can cause a desired air flow regulation adjustment to be fully enacted in a relatively short time frame, such as within a half-seconds, within one seconds, within two seconds, within three seconds, within four seconds, and/or within five seconds from the time of manual input by the user via an electronic input device or manual actuation of a lever or other mechanical device. These exemplary time period are for some embodiments, and in other embodiment the resistance adjustment time periods can be smaller or greater.

Embodiment that includes a variable resistance mechanism that provide increased resistance at higher angular velocity and a rapid resistance mechanism that allow a user to quickly change the resistance at a given angular velocity allow the machine 10 to be used for high intensity interval training. In an exemplary exercise method, a user can perform repeated interval alternating between high intensity period and low intensity periods. High intensity periods can be performed with the adjustable resistance mechanism, such as the air brake 50, set to a low resistance setting (e.g., with the inlet plate 53 blocking air flow through the air brake 50). At a low resistance settings, the user can drive the pedal 32 and/or handle 34 at a relatively high reciprocation frequency, which can cause increased energy exertion because, even though there is reduced resistance from the air brake 50, the user is caused to lift and lower his own body weight a significant distance for each reciprocation, like with a traditional stair climber machine. The rapid climbing motion can lead to an intense energy exertion. Such a high intensity period can last any length of time, such as less than one minute, or less than 30 seconds, while providing sufficient energy exertion as the user desires.

Low intensity periods can be performed with the adjustable resistance mechanism, such as the air brake 50, set to a high resistance setting (e.g., with the inlet plate 53 allowing maximum air flow through the air brake 50). At a high resistance settings, the user can be restricted to driving the pedals 32 and/or handles 34 only at relatively low reciprocation frequencies, which can cause reduced energy exertion because, even though there is increased resistance from the air brake 50, the user does not have to lift and lower his own body weight as often and can therefor conserve energy. The relatively slower climbing motion can provide a rest period between high intensity periods. Such a low intensity period or rest period can last any length of time, such as less than two minutes, or less than about 90 seconds. An exemplary interval training session can include any number of high intensity and low intensity periods, such less than 10 of each and/or less than about 20 minute total, while providing a total energy exertion that requires significantly longer exercise time, or is not possible, on a traditional stair climber or a traditional elliptical machine.

In accordance with various embodiments, the exercise machine illustrated in FIGS. 1-7 may have some differences compared to the machine illustrated in FIGS. 8-11. For example, in FIGS. 1-7 the lower reciprocating members 26 support the rollers. As shown, the first and second pedals 32 are a contiguous portions of the first and second lower reciprocating members 26. The first and second lower reciprocating members 26 are each tubular structure with a bend in the tubular structure defining the first and second pedals 32 and with the respective platforms and the respective rollers extending the respective tubular structure forming the first and second pedals. The lower reciprocating member in FIGS. 8-11 attaches directly to a frame (e.g., bracket 126*a*) that support the foot pads 126*b*. It is understood that the features of each of the embodiments are applicable to the other.

Referring to FIG. 8-11, the machine 100 may include a frame 112 having a base 114 for contact with a support surface, a vertical braces 116 extending from the base 114 to an upper support structure 120, and first and second inclined members 122 that extend between the base 114 and the vertical braces 116. As reflected in the various embodiments discussed herein, the machine 100 may include an upper moment producing mechanism. The machine may also or alternatively includes a lower moment producing mechanism. The upper moment producing mechanism and the lower moment producing mechanisms may each provide an input into a crankshaft 125 inducing a tendency for the crankshaft 125 to rotate about axis A. Each mechanism may have a single or multiple separate linkages that produce the moment on the crankshaft 125. For example, the upper moment-producing mechanism may include one or more upper linkages extending from the handles 134 to the crankshaft 125. The lower moment-producing mechanism may include one or more lower linkages extending from the pedals 132 to crankshaft 125. In one example, each machine may have two handles 134 and two linkages connecting each of the handles to the crankshaft 125. Likewise, the lower moment-producing mechanism may include two pedals and have two linkages connecting each of the two pedals to the crankshaft 125. The crank shaft 125 may have a first side and a second side rotatable about a crank shaft axis A. The first side and the second side may be fixedly connected to the two upper linkages and/or the two lower linkages, respectively.

In various embodiments, the lower moment-producing mechanism may include a first lower linkage and a second lower linkage corresponding to a left and right side of machine 100. The first and second lower linkages may include one or more of first and second pedal 132, first and second rollers 130, first and second lower reciprocating members 126, and/or first and second crank arms 128, respectively. The first and second lower linkages may operably transmit a force input from the user into a moment about the crank shaft 125.

The machine 100 may include first and/or second crank wheel 124 which may be rotatably supported on opposite side of the upper support structure 120 about a horizontal rotation axis A. The first and second crank arms 128 are fixed relative to the respective crank shaft 125 which may in turn be fixed relative to the respective first and second crank wheel 124. The crank arm 128 may be positioned on outer side of the crank wheel 124. The crank arm 128 may be rotatable about the rotation axis A, such that rotation of the crank arm 128 cause the crank wheel 124 and/or the crank shaft 125 to rotate. The first and second crank arms 128 extend from central end at the axis A in opposite radial direction to respective radial ends. For example, the first side and the second side of the crank shaft 125 may be fixedly connected to second ends of first and second lower crank arms. First and second lower reciprocating member 126 have forward ends that are pivotably coupled to the radial end of the first and second crank arms 128, respectively, and rearward ends that are coupled to first and second foot pedals 132, respectively. First and second rollers 130 may be coupled to intermediate portions of the first and second lower reciprocating members 126, respectively. In various examples, the first and second pedals 132 may each have first end with first and second rollers 130, respectively, extending therefrom. Each of the first and second pedals 132 may have second end with first and second platforms **126*b* (or interchangeably foot pads 126*b*), respectively. First and second brackets 126*a* may form the portions of the first and second pedals 132 which connect the first and second platforms 132*b* and the first and second brackets 132*a*. The first and second lower reciprocating members 126 may be fixedly connected to the first and second brackets 126*a* between the first and second rollers 130, respectively, and the first and second platforms 132*b*, respectively. The connection may be closer to a front of the first and second platforms than the first and second rollers 130. The first and second platforms 132*b* may be operable for a user to stand on and provide an input force. The first and second rollers 130 rotate about individual roller axes T. The first and second rollers may rotate on and travel along first and second inclined members 122, respectively. The first and second inclined members 122 may form a travel path along the length and height of the first and second incline members. The roller 130 can rollingly translate along the inclined members 122 of the frame 112. In alternative embodiments, other bearing mechanisms can be used to provide translational motion of the lower reciprocating members 126 along the inclined members 122 instead of or in addition to the rollers 130**, such as sliding friction-type bearings.

When the foot pedals 132 are driven by a user, the intermediate portion of the lower reciprocating members 126 translate in a substantially linear path via the rollers 130 along the inclined members 122, and the front end of the lower reciprocating members 126 move in circular paths about the rotation axis A, which drives the crank arms 128 and the crank wheels 124 in a rotational motion about axis A. The combination of the circular motion of the forward ends of the lower reciprocating members 126 and the linear motion of the intermediate portions of the foot members causes the pedals 132 at the rearward ends of the foot member to move in non-circular closed loop paths, such as substantially ovular and/or substantially elliptical closed loop paths. The closed loop path traversed by the pedals 132 can be substantially similar to those described with reference to the pedal 32 of the machine 10. A closed loop path traversed by the foot pedals 132 can have a major axis defined by the two points of the path that are furthest apart. The major axis of one or more of the closed loop path traversed by the pedals 132 can have an angle of inclination closer to vertical than to horizontal, such as at least 45°, at least 50°, at least 55°, at least 60°, at least 65°, at least 70°, at least 75°, at least 80°, and/or at least 85°, relative to a horizontal plane defined by the base 114. To cause such inclination of the closed loop path of the pedals 132, the inclined members 122 can includes a substantially linear portion over which the rollers 130 traverse. The inclined member 122 form a large angle of inclination a relative to the horizontal base 114, such as at least 45°, at least 50°, at least 55°, at least 60°, at least 65°, at least 70°, at least 75°, at least 80°, and/or at least 85°. This large angle of inclination which set the path for the foot pedals motion can provide the user with a lower body exercise more akin to climbing than to walking or running on a level surface. Such a lower body exercise can be similar to that provided by a traditional stair climbing machine.

In various embodiments, the upper moment-producing mechanism 90 may include a first upper linkage 91 and a second upper linkage 91 corresponding to a left and right side of machine 100. The first and second upper linkage 91 may include one or more of first and second handle 134, first and second links 138, first and second upper reciprocating member 140, and/or first and virtual crank arm **142*a*, respectively. The first and second upper linkage 91 may operably transmit a force input from the user, at the handle 134, into a moment about the crank shaft 125**.

Figure 8:
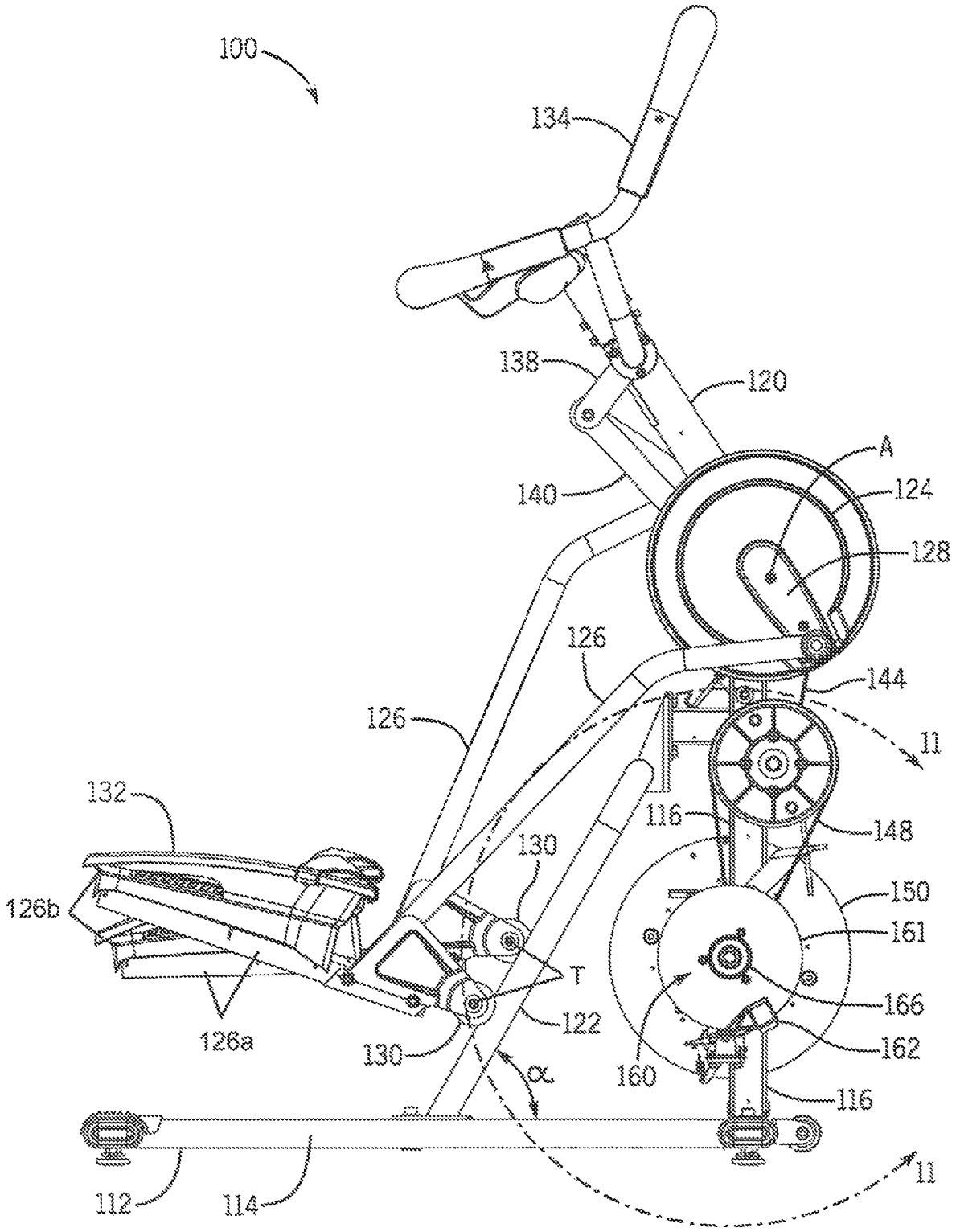
FIG. 8 is a right side view of another exemplary exercise machine.
Figure 9:
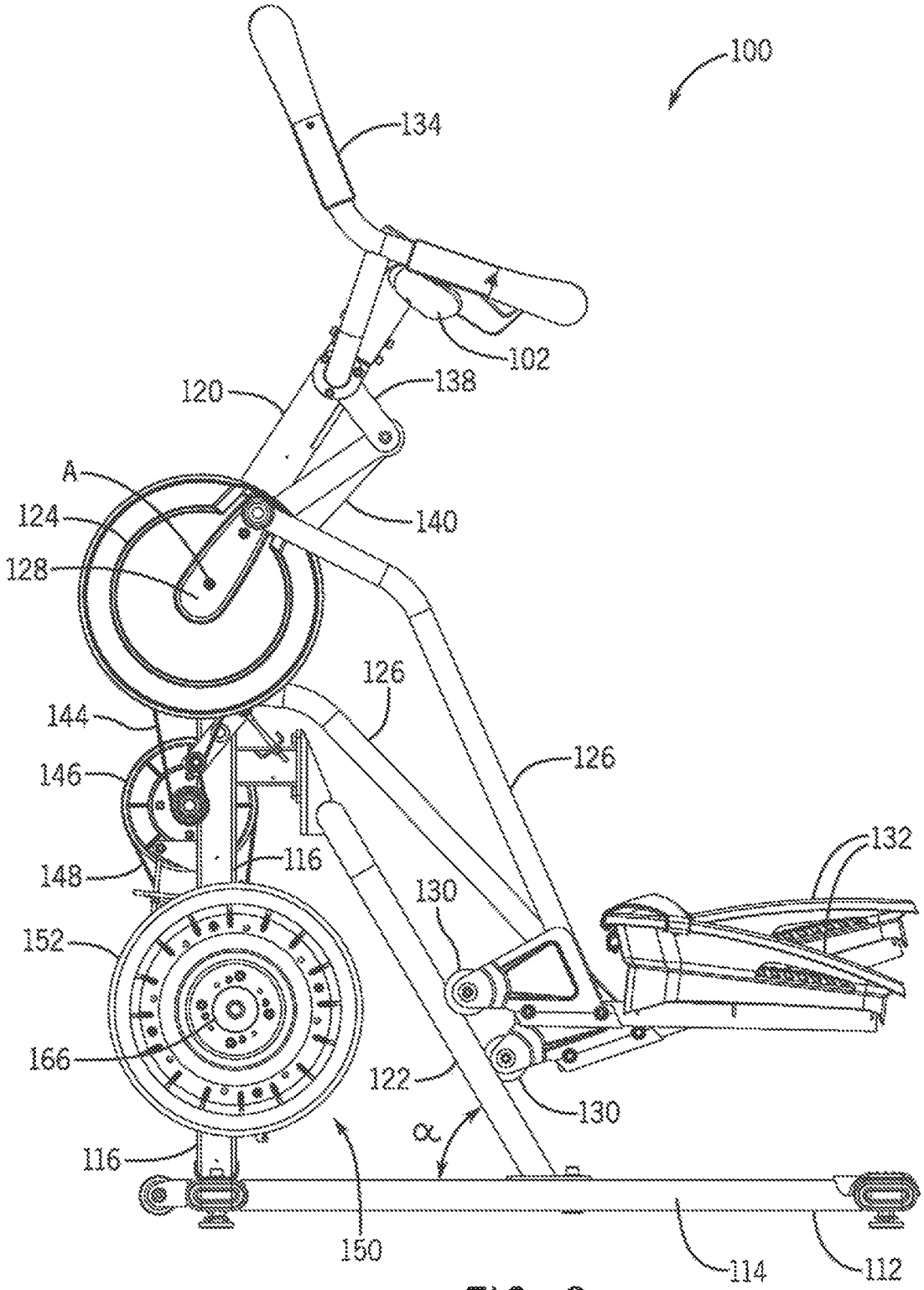
FIG. 9 is a left side view of the machine of FIG. 8.
Figure 9A:
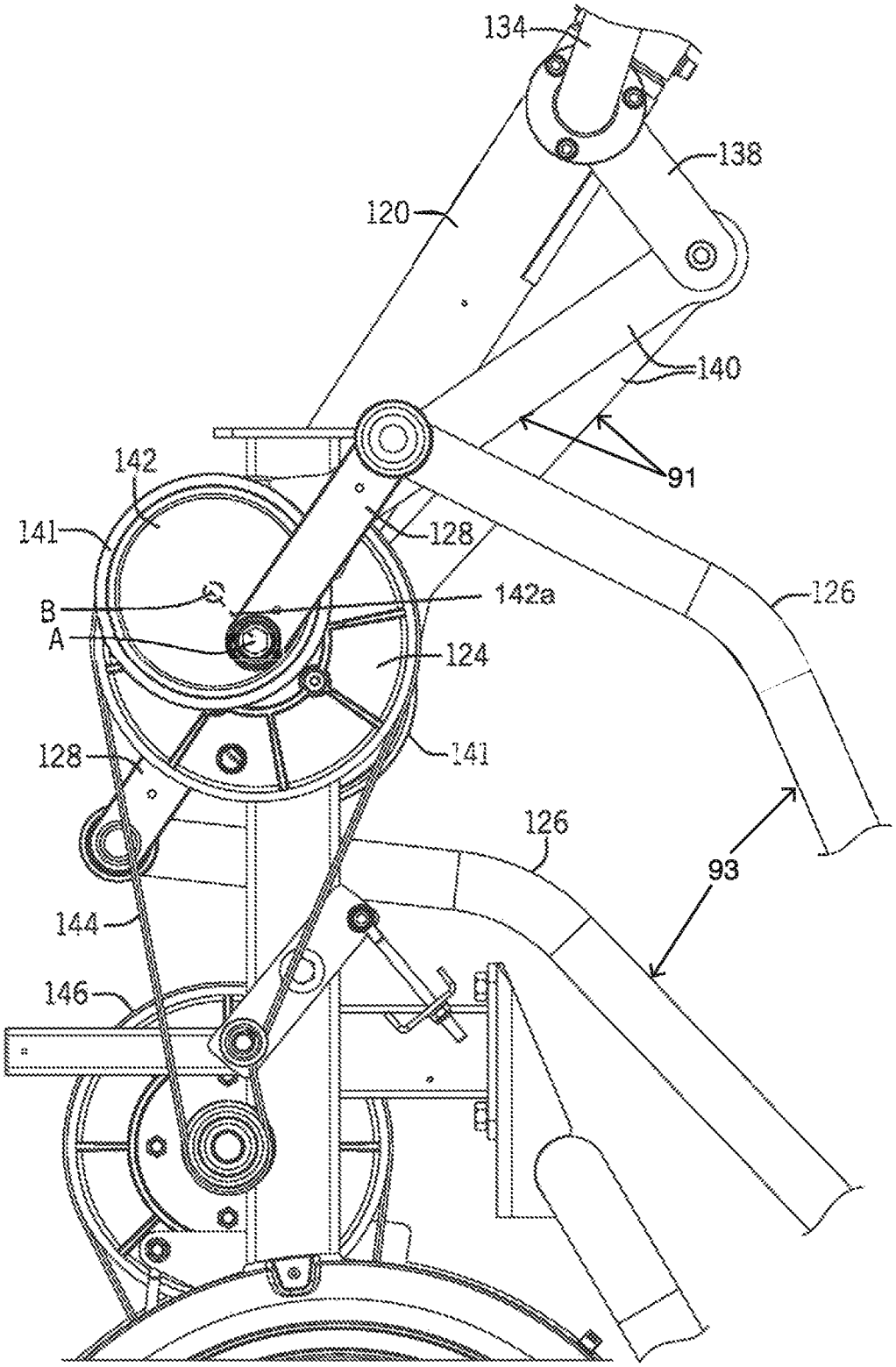
FIG. 9A-9F are simplified sectional and full view of FIG. 9 highlighting the input linkage of the example exercise machine.
Figure 10:
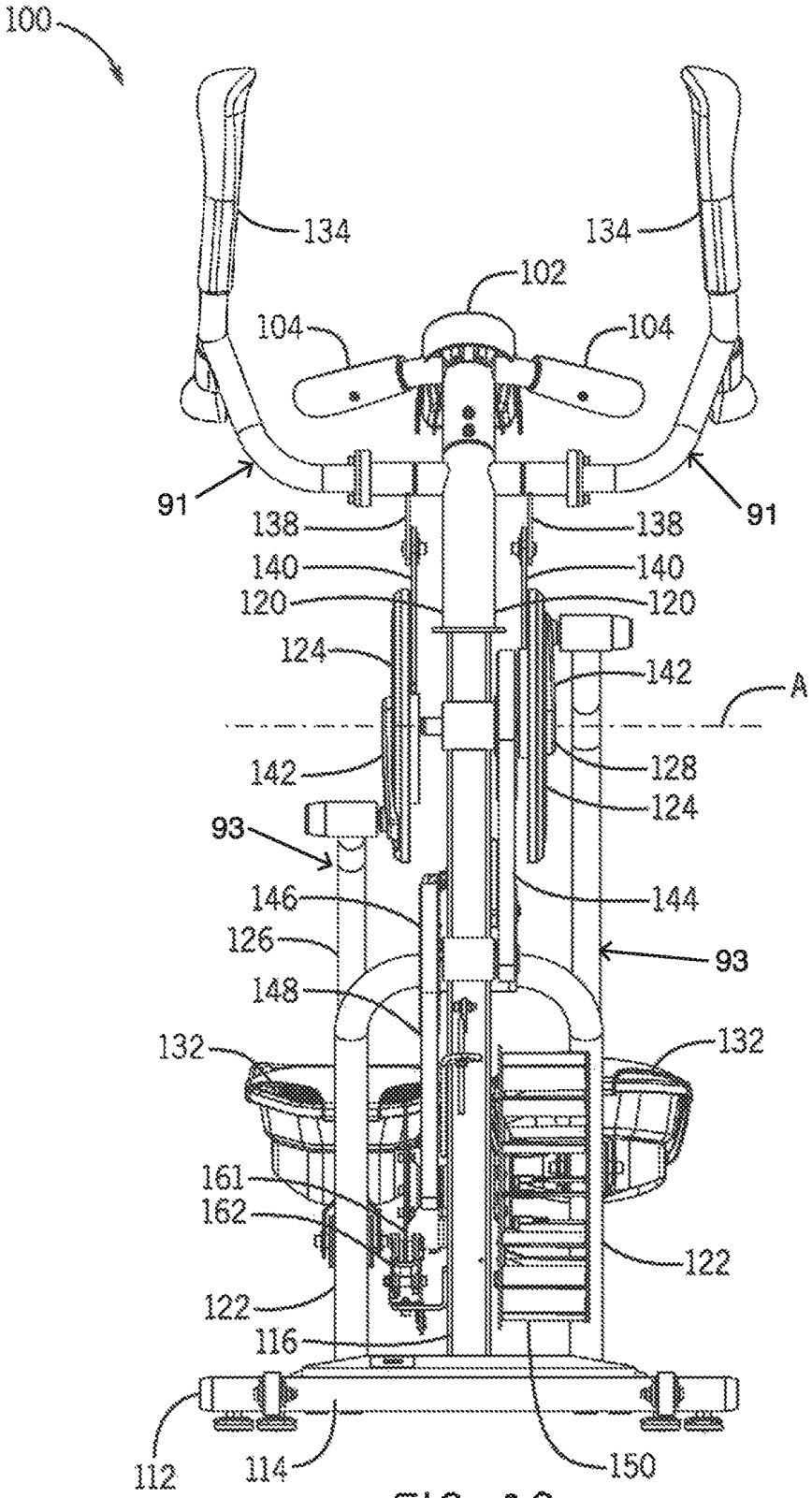
FIG. 10 is a front view of the machine of FIG. 8.

With reference to FIG. 8-10, the first and second handles 134 may be pivotally coupled to the upper support structure 120 of the frame 112 at a horizontal axis D. Rotation of the handle 134 about the horizontal axis D cause corresponding rotation of first and second links 138, which are pivotably coupled at their radial end to first and second upper reciprocating member 140. The first and second links 138 and the handle 134 may be pivotable about the D axis. For example, the first and second links 138 may be cantilevered off of handle 134 at the pivot aligned with the D axis. Each of the first and second links 138 may have angle ω with the respective handles 134. The angle may be measured from a plane passing through the axis D and the curve in the handle proximate the connection to the link 138. The angle ω may be any angle such as angles between 0 and 180 degrees. The angle ω may be optimized to one that is most comfortable to a single user or an average user. The lower end of the upper reciprocating member 140 may pivotably connect to the first and second virtual crank arm **142*a*, respectively. The first and second virtual crank arm 142*a* may be rotatable relative to the rest of the upper reciprocating member 140 about respective axe B (which may be referred to a virtual crank arm axe). Axe B may be parallel to the crank axis A. Each axis B may be located proximal to an end of each of the upper reciprocating members 140. Each axis B may also be located proximal to one end of the virtual crank arm 142*a*. Each axis B may be off set radially in opposite direction from the axis A. Each respective virtual crank arm 142*a* may be perpendicular to axis A and each of the axe B, respectively. The distance between axis A and each axis B may define approximately the length of the virtual crank arm. This distance between axis A and each axis B is also the length of the moment arm of each virtual crank arm 142***a* which exert a moment on the crank shaft. As used herein, the virtual crank arm 142*a* may be any device which exert a moment on the crank shaft 125. For example, a used above the virtual crank arm 142*a* may be the disk 142. In another example, the virtual crank arm 142*a* may be a crank arm similar to crank arm 128. Each of the virtual crank arm may be a single length of semi-ridged to ridged material having pivot proximal to each end with one of the reciprocating member pivotably connected along axis B proximal to one end and the crank shaft fixedly connected along axis A proximally connected to the other end. The virtual crank arm may include more than two pivot and have any shape. A discussed hereafter, the virtual crank arm is described a being disk 142 but this is merely a an example, as the virtual crank arm may take any form operable to apply a moment to crank shaft 125. As such, each embodiment including the disk may also include the virtual crank arm or any other embodiment disk herein or would be understood by one of ordinary skill in the art a applicable.

In the embodiment in which the vertical crank arm 142*a* is the rotatable disk 142, the structure of the upper reciprocating members 140 and rotatable disks 142 should be understood to be similar to the upper reciprocating members 40 and disks 42 of the machines 10, as shown in FIG. 3-7. However any of the virtual crank arms, crank arms, disks or the like may also be applicable to the embodiments of FIGS. 3-7. The lower ends of the upper reciprocating members 140 may be positioned just inside of the crank wheel 124, a shown in FIG. 10. As the crank wheel 124 rotate about the axis A, the disk axe B orbit about the axis A. The disks 142 are also pivotably coupled to the crank axis A, such that the disks 142 rotate within the respective lower ends of the upper reciprocating members 140 as the disks 142 pivot about the crank axis A on opposite side of the upper support member 120. The disk 142 can be fixed relative to the respective crank arms 128, such that they rotate in unison around the crank axis A to crank the crank wheel 124 when the pedals 132 and/or the handles 134 are driven by a user.

The first and second links 138 may have additional pivots coaxial with axis C. The upper reciprocating members 140 may be connected to the links 138 at the pivot coaxial with axis C. A indicated above, the upper reciprocating members 140 may be connected with the annular collars 141. Annular collar 141 encompasses rotatable disk 142 with the two being able to rotate independent of one another. As the handles 134 articulate back and forth they move link 138 in an arc, which in turn articulate the upper reciprocating member 140. Via the fixed connection between the upper reciprocating member 140 and annular collar 141, the articulation of handle 134 also move annular collar 141. As rotatable disk 142 is fixedly connected to and rotatable around the crank shaft which pivot about axis A, rotatable disk 142 also rotates about axis A. As the upper reciprocating member 140 articulate back and forth it forces the annular collar 141 toward and away from the axis A along a circular path with the result of causing axis B and/or the center of disk 142 to circularly orbit around axis A.

Figure 9B:
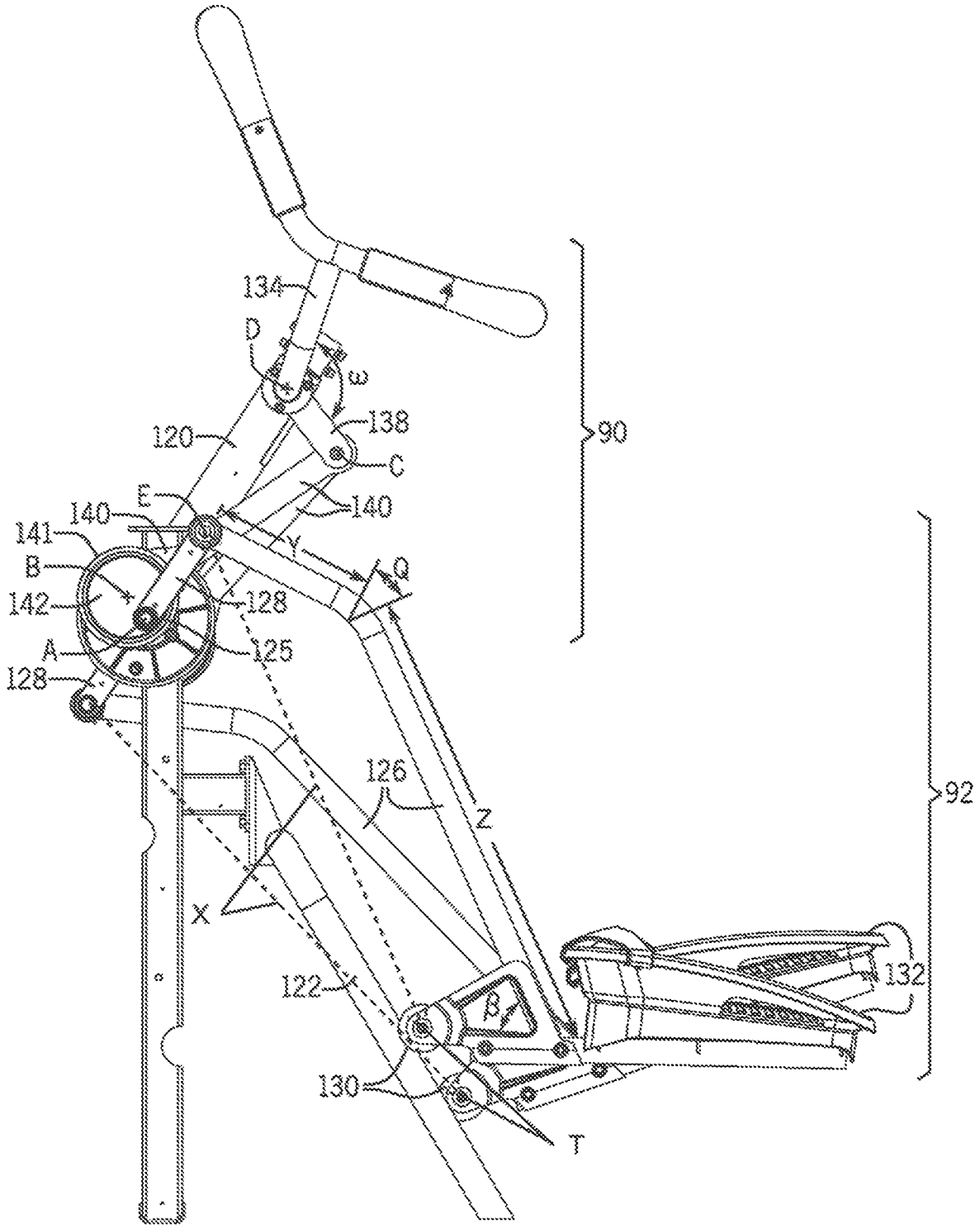
Figure 9C:
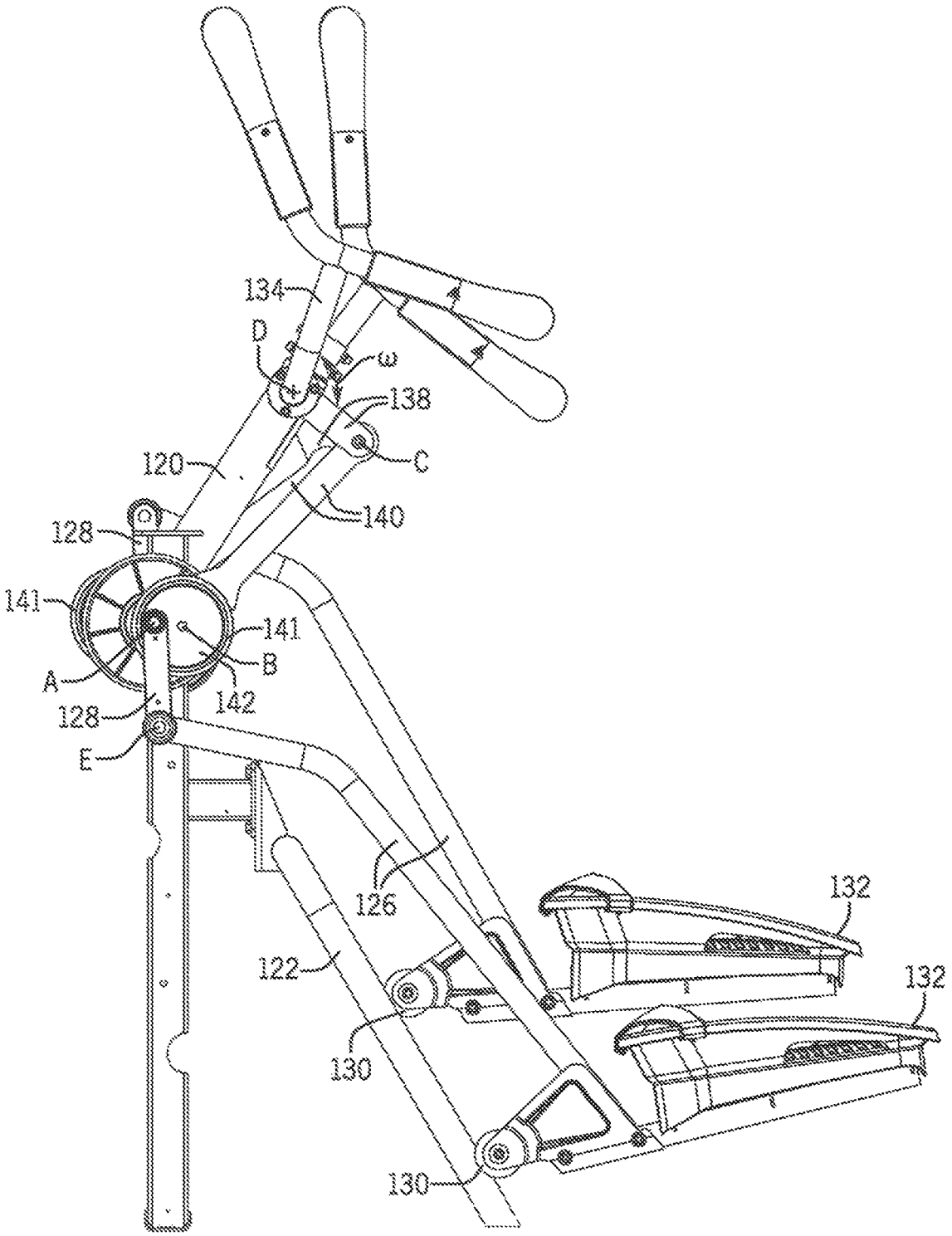
Figure 9D:
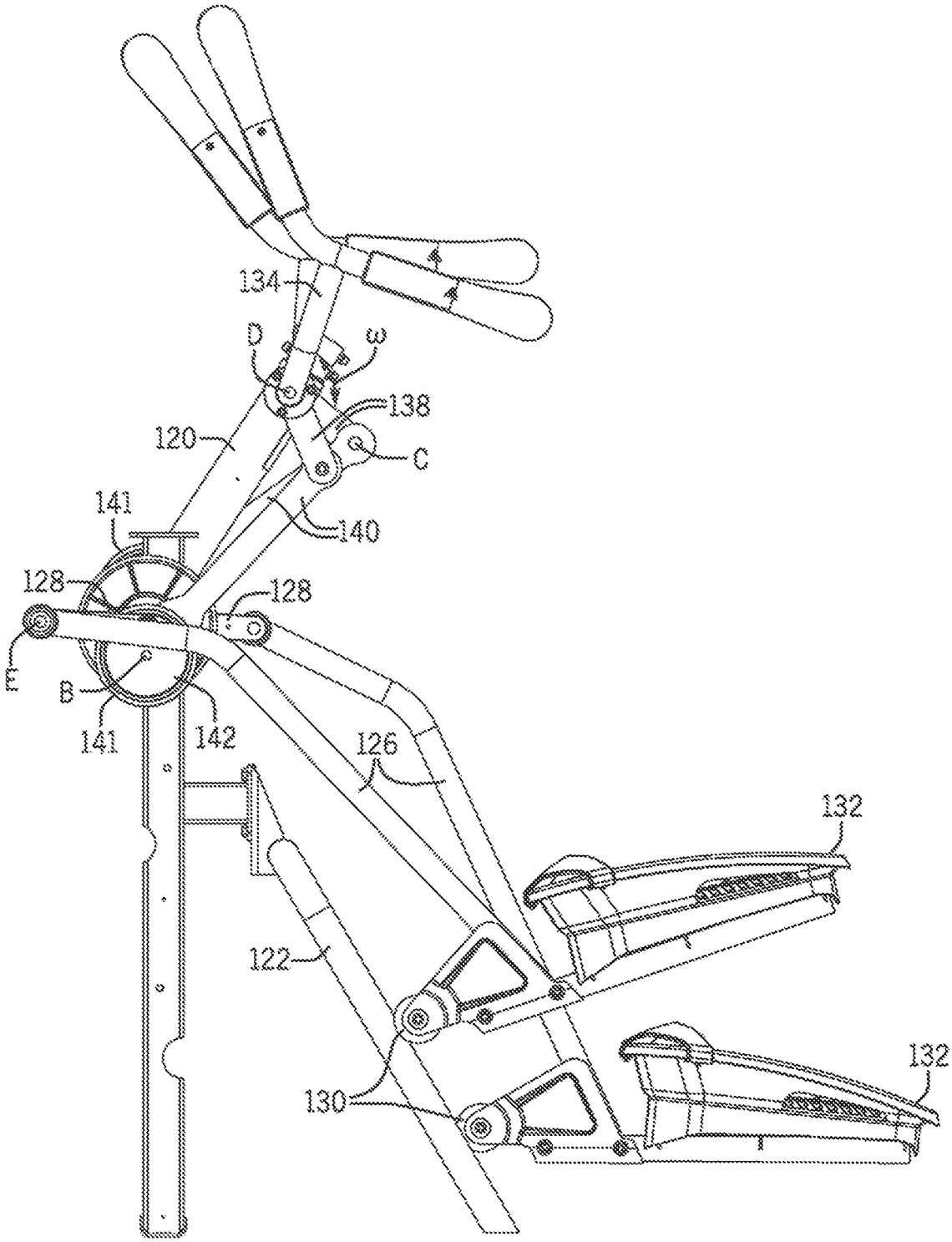
Figure 9E:
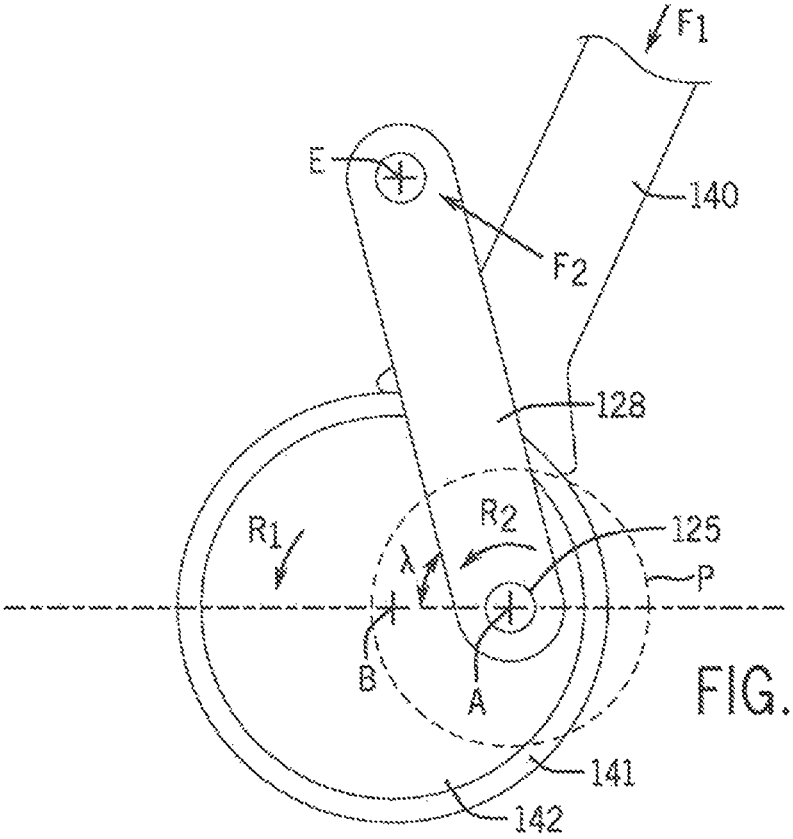
Figure 9F:
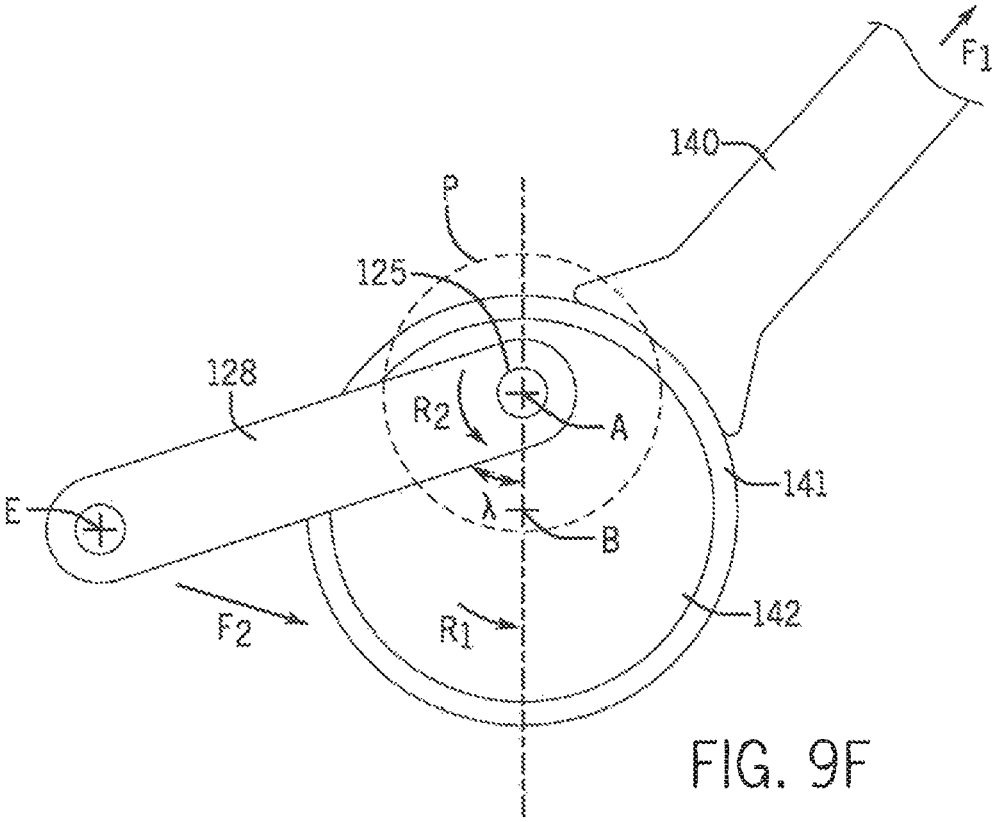
Figure 9H:
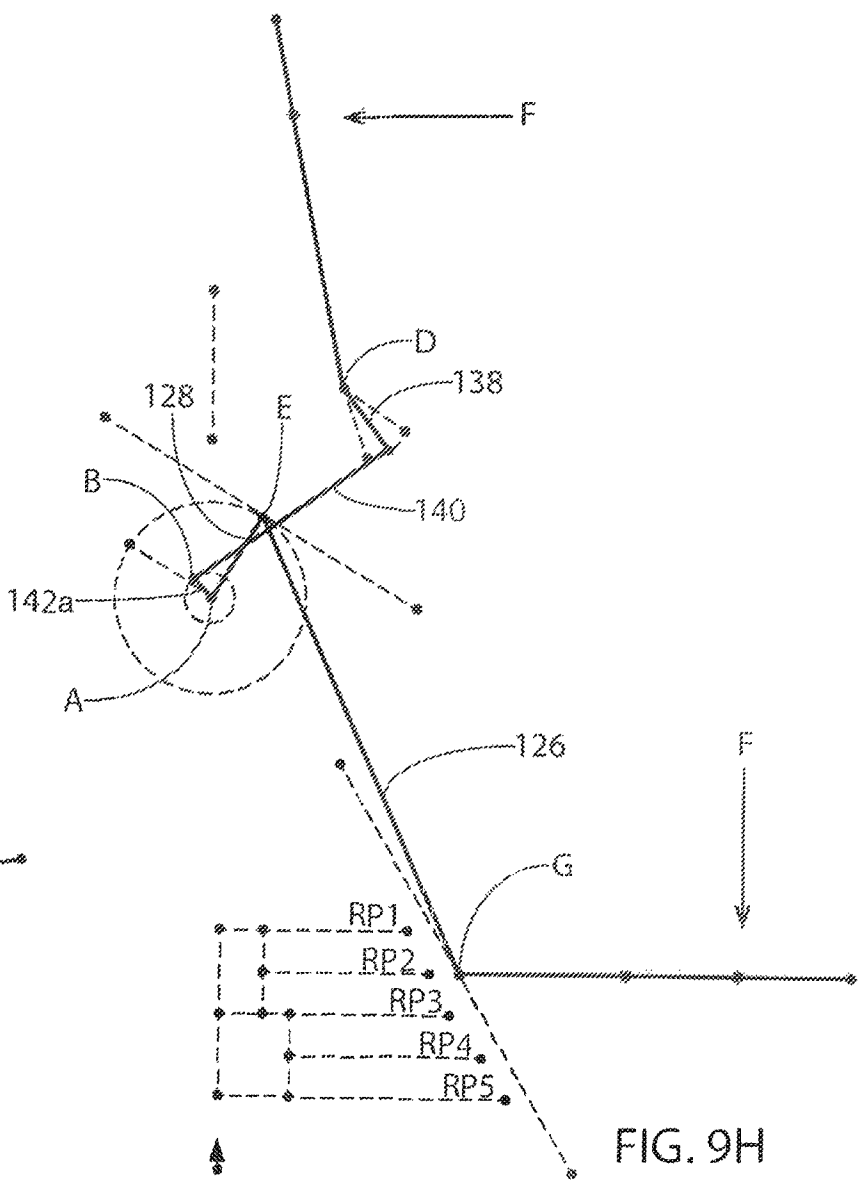
FIG. 9G-9N are schematic view stepping through a cycle of the machine relative to various positions of the roller through its range of travel.
Figure 9G:
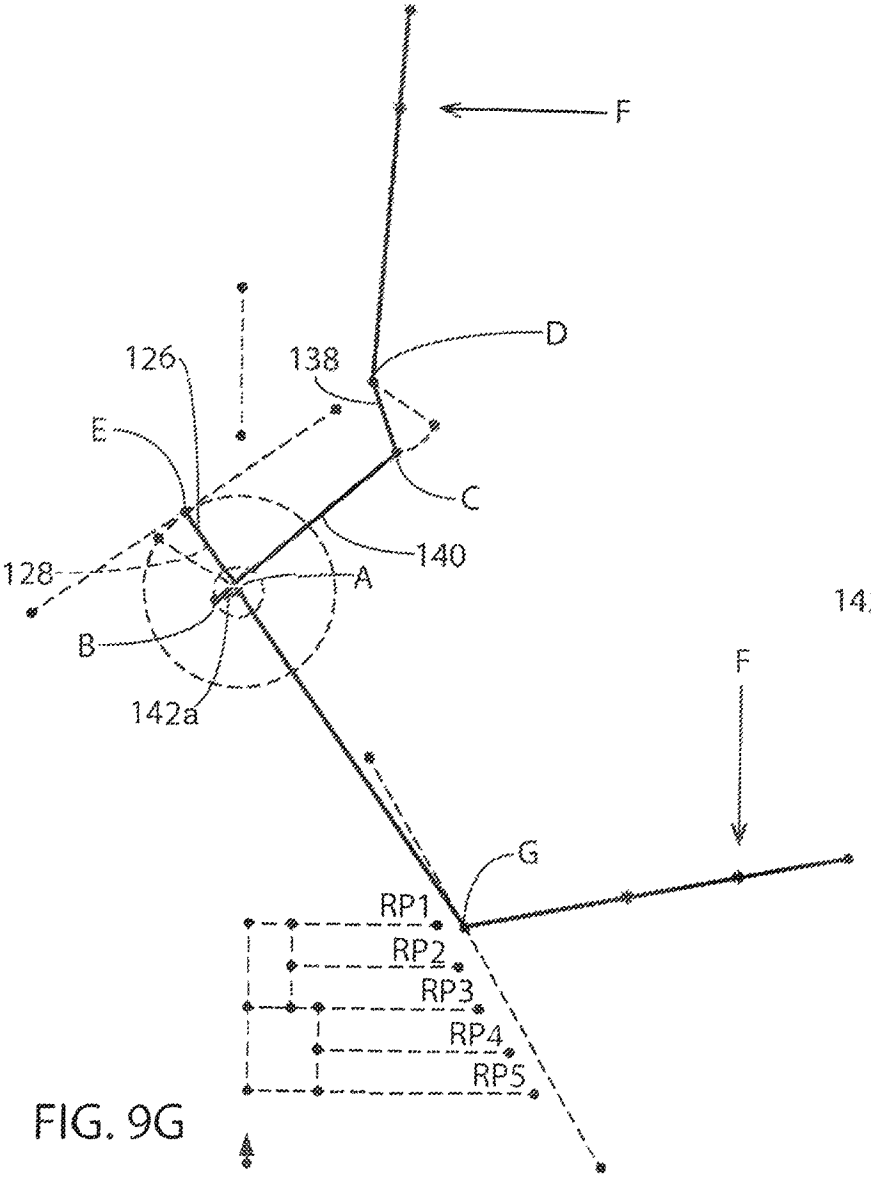
Figure 9J:
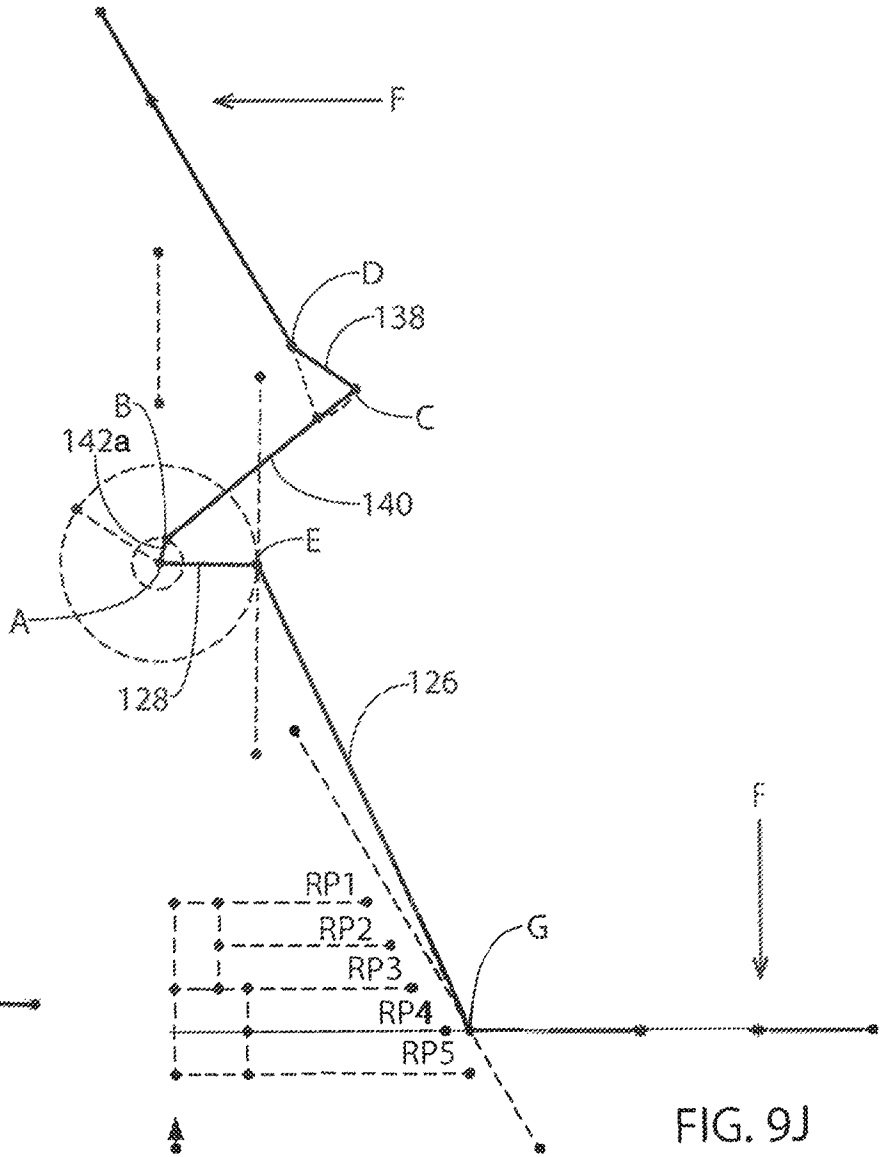
Figure 9I:
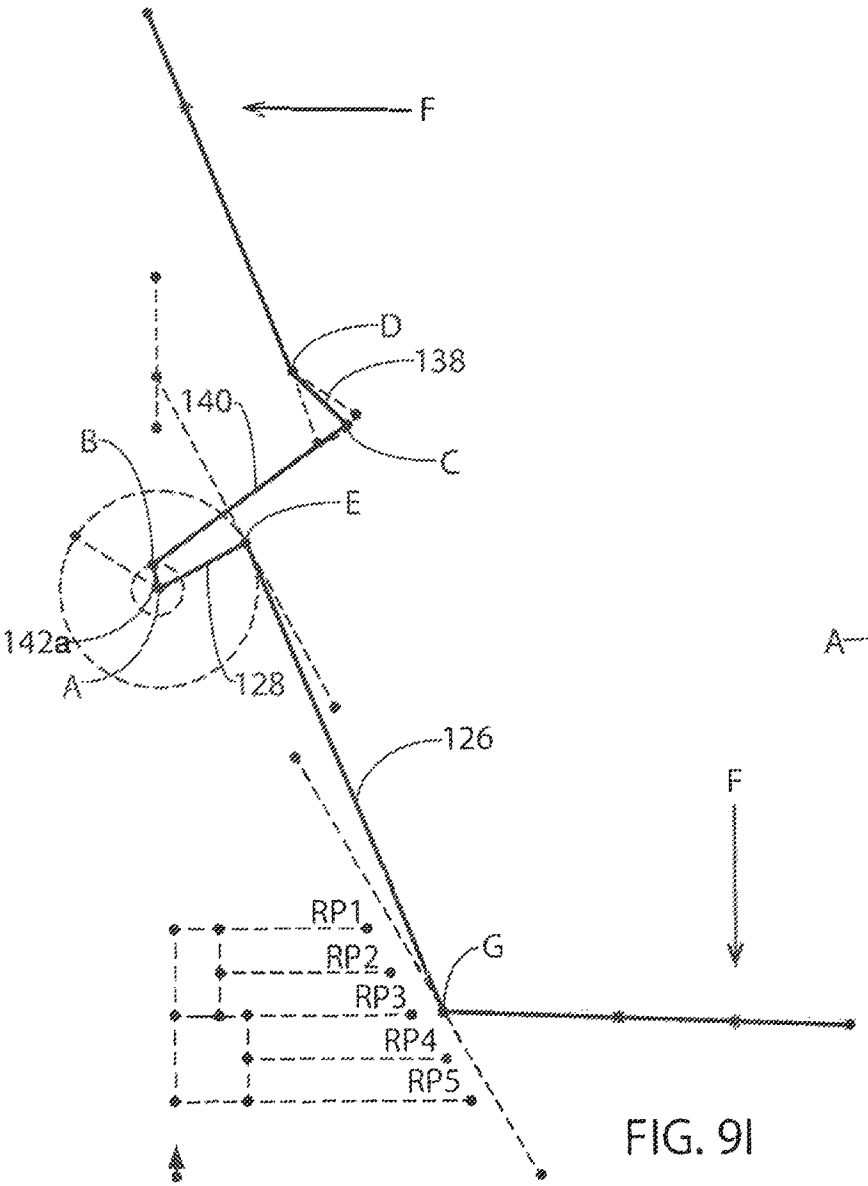
Figure 9L:
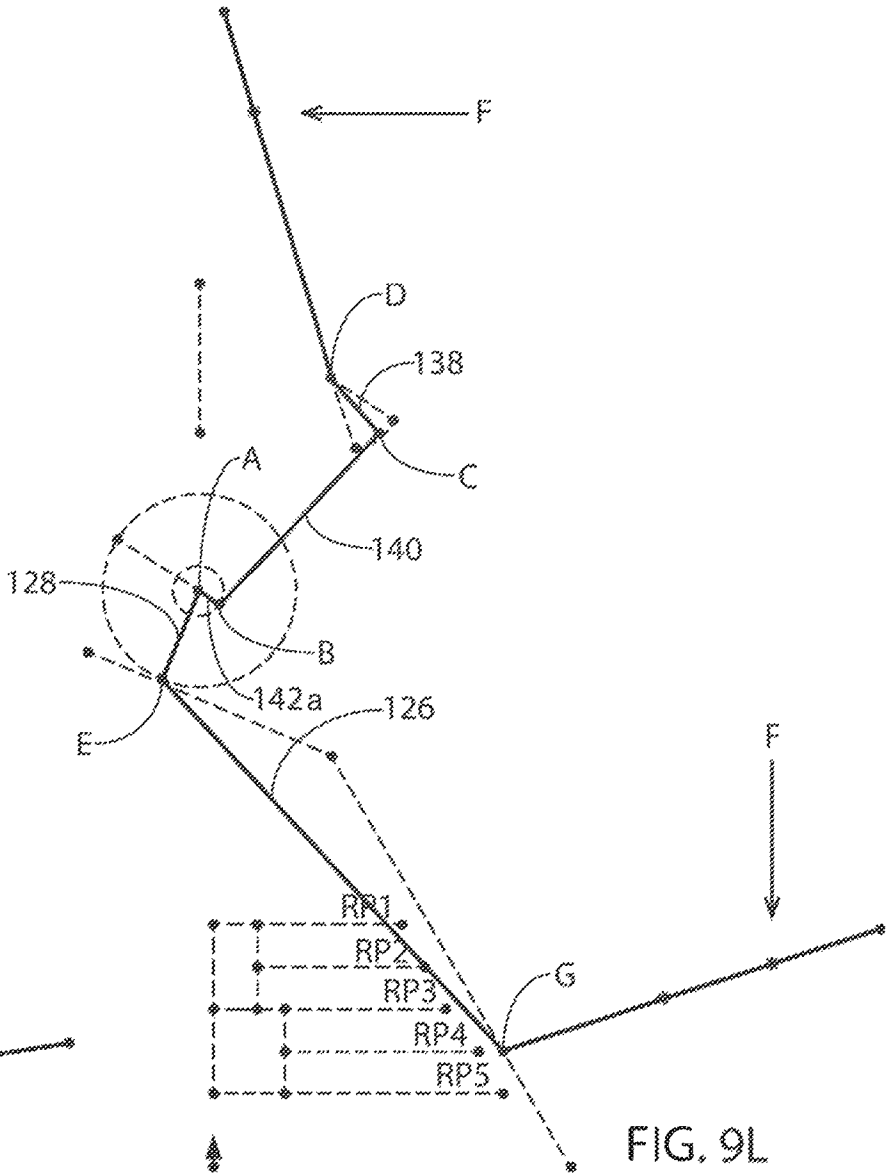
Figure 9K:
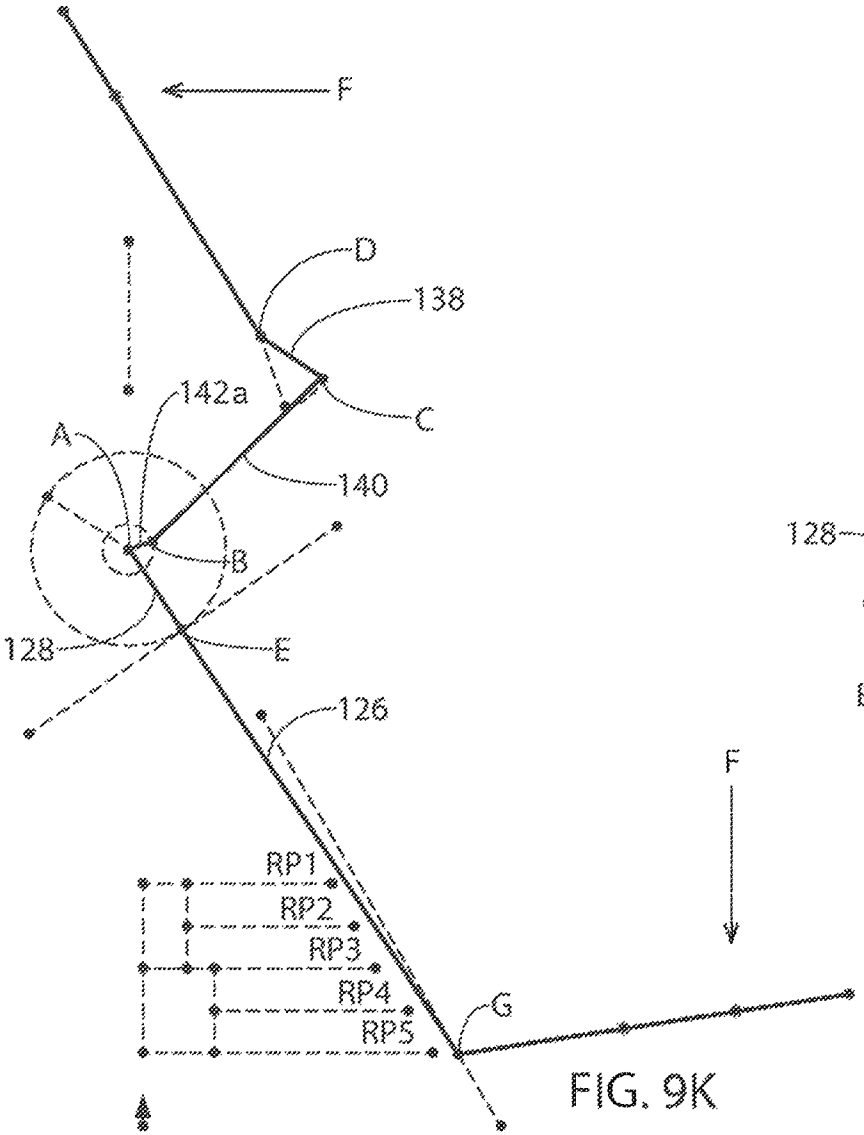
Figure 9N:
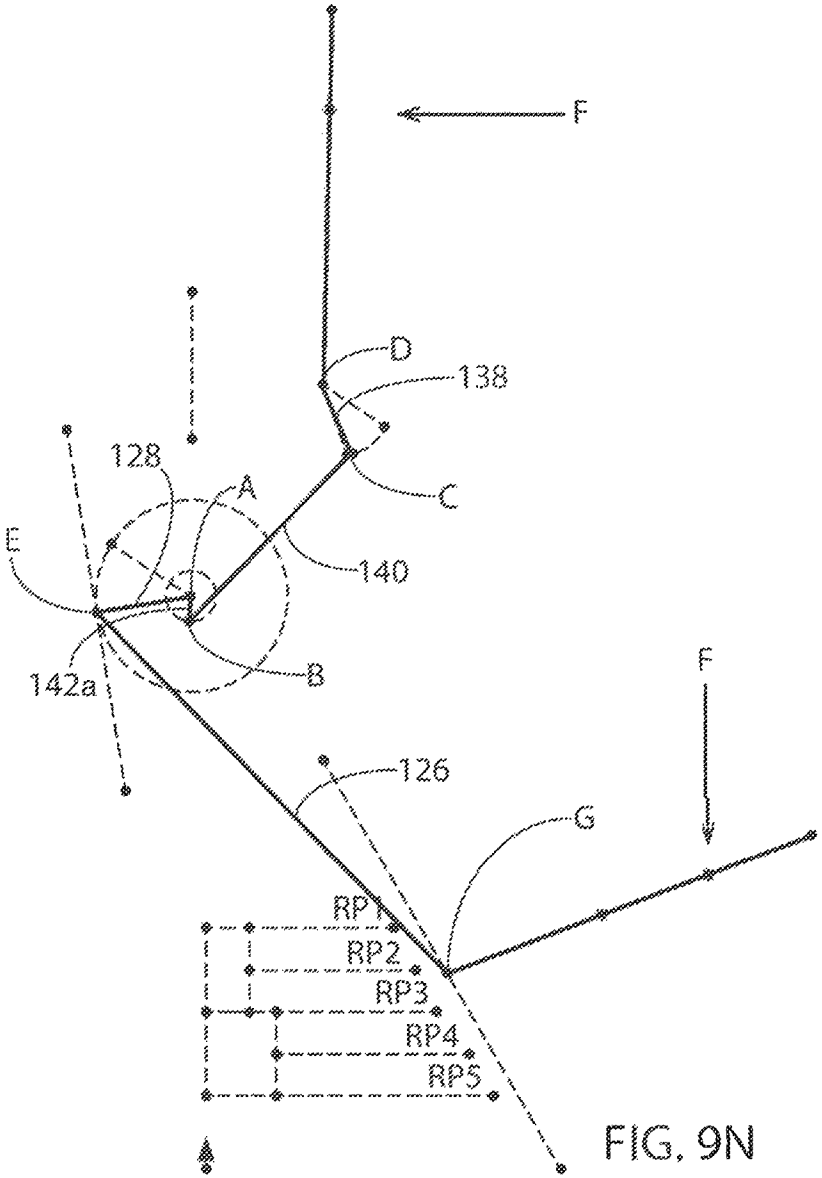
Figure 9M:
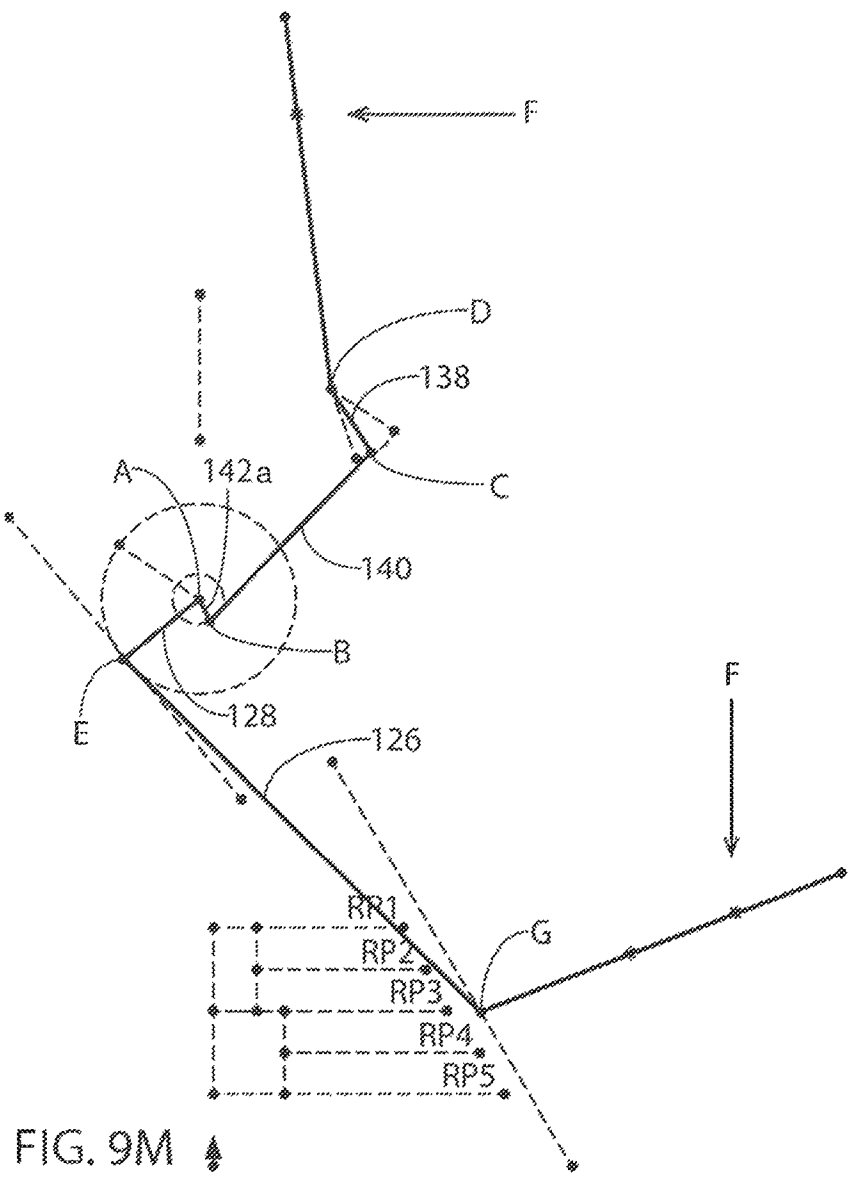

In accordance with various embodiments, the upper linkage 91 may be an eccentric linkage. As illustrated in FIG. 9E, the upper reciprocating member 140 drive the eccentric wheel which include the annular collar 141 and the disk 142. With the disk rotating around axis A as the fixed pivot, the disk center axis B travel around A in a circular path. This path is possible because of the freedom of relative rotational movement between the annular collar 141 and the disk 142. The distance between axis A and axis B is operable as the rotating arm of the linkage. As shown in the diagram illustrated in FIG. 9E, a force F1 is applied to the upper reciprocating member 140. For example, the force may be in the direction shown or opposite the direction shown. If in the direction shown by F1, the upper reciprocating member 140 and the annular collar 141 place a load on disk 142 through axis B. However, a disk 142 is fixed relative to crank shaft 125, which is rotatable around axis A, the load on disk 142 cause a torque to be placed on the crank shaft 125, which is coaxial with axis A. As the force F1 is sufficient to overcome the resistance in crank shaft 125, the disk 142 begins to rotate in direction R1 and the crank shaft begins to rotate in direction R2. With F1 in the opposite direction, R1 and R2 would likewise be in the opposite direction. As illustrated by FIG. 9F, as the cycle continue for the eccentric linkage, the force F1 must change direction in order to continue driving rotation in the direction R1, R2 of the disk 142 and crank shaft 125 respectively.

In accordance with various embodiments, the second mechanical advantage is produced by the combination of components within the lower linkage 93. Within the lower linkage 93, the pedals 132 pivot around the first and second rollers 30 in response to force being exerted against the first and second lower reciprocating members 126 through the pedal 132. The force on the first and second lower reciprocating members 126 drive the first and second crank arms 128 respectively. The crank arm 128 are pivotably connected at axes E to the first and second lower reciprocating members 126 and fixedly connected to the crank shaft 125 at axis A. As the first and second lower reciprocating members 126 are articulated, the force (e.g. F2 shown in FIG. 9E, 9F) drive the crank arms 128, which rotate the crank shaft 125 about axis A. FIGS. 9B, 9C, and 9D each how the pedals 132 in different positions with corresponding different positions in the crank arm 128. These corresponding different positions in the crank arm 128 also represent rotation of the crank shaft 125 which is fixedly attached to the crank arm 128. Due to the fixed attachment, the crank arm 128 can transmit input to the crank shaft 125 that the crank arms 128 receive from the first and second lower reciprocating members 126. The crank arms 128 may be fixedly positioned relative to disk 142. A discussed above, the disk 142 may have a virtual crank arm 142*a* which is the portion of the disk 142 extending approximately perpendicular to and between axis B and axis A.

As shown in FIG. 9E, the virtual crank arm 142*a* may be set at an angle of $\lambda$ from the angle of the crank arm 128 (i.e. the component extending approximately perpendicular to and between axis A and Axis E.) As the disk 142 and the crank arm 128 rotate, for example 90 degrees, the crank arm 128 may stay at the same relative angle to the virtual crank arm 142*a*. The angle $\lambda$ may be between any angle (i.e. 0-360 degree). In one example, the angle $\lambda$ may be between 60° and 90°. In one example, the angle $\lambda$ may be 75°.

Understanding this exemplary embodiment of linkages 91 and 93, it may be understood that the mechanical advantage of the linkages may be manipulated by altering the characteristics of the various elements. For example, in linkage 91, the leverage applied by the handles 134 may be established by length of the handles or the location from which the handles 134 receive the input from the user. The leverage applied by the first and second links 138 may be established by the distance from axis D to axis C. The leverage applied by the eccentric linkage may be established by the distance between axis B and axis A. The upper reciprocating member 140 may connect the first and second links 138 to the eccentric linkage (disk 142 and annular collar 141) over the distance from axis C to axis B. The ratio of the distance between axe D and C compared to the distance between axis B and A (i.e. D-C:B-A) may be in one example, between 1:4 and 4:1. In another example, the ratio may be between 1:1 and 4:1. In another example, the ratio may be between 2:1 and 3:1. In another example, the ratio may be about 2.8:1. In one example, the distance from axis D to axis C may be about 103 mm and the distance from axis B to axis A may be about 35 mm. This defines a ratio of about 2.9:1. Similar ratios may apply to the ratio of axis B to axis A compared to axis A to axis E (i.e. B-A:A-E). In various examples, the distance from axis A to axis E may be about 132 mm. In various examples, the distance from either of axes E to one of the respective axes T (i.e. one of the axe around which the roller rotate) is about 683 mm. The distance from E to T may be represented by X a shown in FIG. 9B. While X generally follow the length of the lower reciprocating member, it may be noted as discussed herein that the lower reciprocating member 126 may not be a straight connecting member but may be multiple portion or multiple member with one or more bend occurring intermediately therein as illustrated in FIG. 8, for example.

With reference to FIGS. 9A-9F, the handles 134 provide an input into the crankshaft 125 through the upper linkage. The pedals 132 provide an input into the crankshaft wheel 125 through a lower linkage 93. The crankshaft being fixedly connected to the crank wheel 124 causes the two to rotate together relative to each other.

Each handle may have a linkage assembly, including the handle 134, the pivot axis D, the link 138, the upper reciprocating member 140, and the disk 142. Two handle linkage assemblies may provide input into the crank shaft 125. Each handle linkage may be connected to the crank shaft 125 relative to the pedal linkage assembly such that each of the handles 134 reciprocate in an opposite motion relative to the pedals 132. For example, as the left pedals 132 is moving upward and forward, the left handle 134 pivot rearward, and vice versa.

The upper moment-producing mechanism 90 and the lower moment-producing mechanism 92, functioning together or separately, transmit input by the user at the handle to a rotational movement of the crank shaft 125. In accordance with various embodiments, the upper moment-producing mechanism 90 drives the crankshaft 125 with a first mechanical advantage (e.g. as a comparison of the input force to the moment at the crank shaft). The first mechanical advantage may vary throughout the cycling of the handles 134. For example, as the first and second handles 134 reciprocate back and forth around axis D through the cycle of the machine, the mechanical advantage supplied by the upper moment-producing mechanism 90 to the crank shaft 125 may change with the progression of the cycle of the machine. The upper moment-producing mechanism 90 drives the crankshaft 125 with a second mechanical advantage (e.g. as a comparison of the input force at the pedal to the torque at the crank shaft at a particular instant or angle). The second mechanical advantage may vary throughout the cycle of the pedals as defined by the vertical position of the rollers 130 relative to their top vertical and bottom vertical position. For example, as the pedals 132 change position, the mechanical advantage supplied by the lower moment-producing mechanism 92 may change with the changing position of the pedals 132. The various mechanical advantage profiles may rise to a maximum mechanical advantage for the respective moment-producing mechanisms at certain points in the cycle and may fall to minimum mechanical advantages at other points in the cycle. In this respect, each of the moment-producing mechanism 90, 92 may have a mechanical advantage profile that describes the mechanical effect across the entire cycle of the handles or pedals. The first mechanical advantage profile may be different than the second mechanical advantage profile at any instance in the cycle and/or the profiles may generally be different across the entire cycle. The exercise machine 100 may be configured to balance the user's upper body workout (e.g. at the handles) by utilizing the first mechanical advantage differently as compared to the user's lower body workout (e.g. at the pedals 132) utilizing the second mechanical advantage. In various embodiments, the upper moment-producing mechanism 90 may substantially match the lower moment-producing mechanism 92 at such points where the respective mechanical advantage profiles are near their respective maximums. Regardless of difference or similarities in respective mechanical advantage profiles throughout the cycling of the exercise machine, the inputs to the handles and pedals still work in concert through their respective mechanisms to drive the crankshaft 125.

One example of the structure and characteristics of the exercise machine is provided in the table below and reflected in FIGS. 9G-N. The table represents an embodiment as described below and analyzed as a single linkage such as on one half of a machine (e.g. the left linkage of an exercise machine). The force applied to the handle or the handle force and the force applied to the pedal or the pedal force is shown by arrow F and each of the forces is equal forces. The handle force is applied at a distance about 376 mm from the axis D which locates the force at a position about the middle of the handle grip that a user may typically use. The pedal force is applied to the foot pad at a distance of about 381 mm from the axis T which locates the force at a position about the middle of the foot pad where a user may typically stand. The length from axis D to axis C is about 104 mm. The length from axis B to axis A is about 35 mm. The length from axis A to axis E is about 132 mm. The length from axis E to axis T is about 683 mm. The angle between the member that extends between axis B to axis A and the member that extends between axis A and axis E is about 75°. The exercise machine may include an individual cycle as defined by a full reciprocation of one of the handles, a full rotation of the crankshaft, a full loop of one of the foot pedals, or any other criteria that would indicate a full repetition of the components of the exercise machine. Column 1 below identifies a step in the cycle so as to identify the locations, ranges, and/or changing values of the other attributes in the table. Column 2 identifies positions of the handles relative to the other attributes in the table. Column 3 identifies positions of the roller axis relative to the other attributes in the table. Column 4 identifies the positions of the crankshaft relative to the other attributes as measured from a vertical plane passing through axis A; the angles are measured from 0 to 180° on a first half of the cycle as defined by the crankshaft angle and from −180 to 0° on the second half of the cycle as defined the crankshaft angle. Column 5 identifies the angle between the component that extends between axis D and axis C and the component that extends between axis B and axis C relative to the point in the cycle. Column 6 identifies the angle between the component that extends between axis C and axis B and the component that extends between axis A and axis B relative to the point in the cycle. Column 7 identifies the angle between the component that extends between axis A and axis E and the component that extends between axis T and axis E relative to the point in the cycle. Column 8 identifies the approximate mechanical advantage ratio relative to the point in the cycle. The mechanical advantage ratio is equal to the mechanical advantage in lower moment-producing mechanism 92 divided by the mechanical advantage in the upper moment-producing mechanism 90.

| Machine Cycle Position | Handle Position | Roller position | Crank Arm Angle | DCB angle | CBA angle | AET angle | Mech. Adv. Ratio | FIG. |
|---|---|---|---|---|---|---|---|---|
| 1 | Rear | Proximal Top | −57 | 114 | 0 | −18.3 | N/A | Cycled between FIG. 9N and 9G |
| 2 | Proximal to Rear | Top | −34 | 110 | 20.2 | 0 | N/A | FIG. 9G |
| 3 | Proximal to Middle | Top Mid. | 31 | 88.3 | 80.7 | 55.1 | .86 | FIG. 9H |
| 4 | Forward Mid. | Middle | 62 | 79.0 | 112.0 | 84.4 | 1.05 | FIG. 9I |
| 5 | Proximal to Forward | Bottom Mid. | 91 | 73.3 | 144 | 115.3 | 1.38 | FIG. 9J |
| 6 | Forward | Proximal to Bottom | 123 | 73.0 | 180 | 152 | N/A | Cycled between FIG. 9J and 9K |
| 7 | Proximal to Forward | Bottom | 147 | 77.6 | 154 | 180 | N/A | FIG. 9K |
| 8 | Proximal to Middle | Bottom Mid. 2 | −158 | 95.5 | 95.8 | 115.3 | .63 | FIG. 9L |
| 9 | Mid. Rear | Middle 2 | −129 | 105.3 | 67.1 | 84.4 | .83 | FIG. 9M |
| 10 | Proximal to Rear | Top Mid. 2 | −99 | 112.7 | 38.2 | 55.1 | 1.2 | FIG. 9N |

In accordance with various embodiments, the roller may travel along the incline member from a bottom position to a top position and back down. The full round trip of the roller may account for a cycle of the exercise machine. As shown in FIG. 9G-9N, the roller may have vertical position along the incline member a indicated by RP1, RP2, RP3, RP4, and RP5. RP1 corresponds to the top vertical position of the roller also reflected in the table above. RP2 corresponds to the top middle vertical position of the roller also reflected in the table above. RP3 corresponds to the middle vertical position of the roller also reflected in the table above. RP4 corresponds to the bottom middle vertical position of the roller also reflected in the table above. RP5 corresponds to the bottom vertical position of the roller also reflected in the table above. During a single cycle, the roller may be positioned at RP2, RP3, and RP4 each twice, once on the way down and once on the way up, thus forming eight example positions. Each of these position may also be accounted for by crank shaft angle as measured off the vertical and also relative position of the handle a shown in the table above. It may be noted that an infinite number of positions exist in each cycle, but these position are shown a mere examples.

The power band of the cycle may be defined as the range in the cycle of the exercise machine in which the moment-producing mechanism (e.g. upper moment-producing mechanism 90 and lower moment-producing mechanism 92) obtain their respective maximum mechanical advantages. Stated another way, the moment-producing mechanism are outside of their respective dead zones, the dead zone being the range of the cycle in which the moment goes to zero. In these dead zones, the ratio between the upper moment-producing mechanism 90 and lower moment-producing mechanism 92 decreases in its usefulness as the ratio may approach zero or infinity. Each cycle may have a plurality of power bands. The cycle may have one power bands, two power bands, three power bands, four power bands, or more. For example, if there are four different linkage (e.g. two upper linkages and two lower linkage) and each linkage ha two dead zone different from the other linkages, in a cycle there may be eight power band existing between each of those dead zones. In another example, if there are four different linkage (e.g. two upper linkages and two lower linkage) and the dead zone of some linkages are the same (e.g. the upper linkage are the same and the lower linkage are the same) and the dead zone of the opposing linkage (e.g. upper linkage versus lower linkage) are different but still close together, then there may not be a power band between the dead zone of the opposing linkages. Linkage on opposite side of the machine (e.g. left versus right side) may have identical mechanical advantage profiles but be 180 degree out of phase, thus having dead zones at the same time but from different parts of the cycle.

In accordance with one example, the table and FIG. 9G-9N how an example of two linkages from the same side of an exercise machine. The exercise machine may have an angular power band between 0° and 110° in one half of the cycle and 155° to 180° and −180° to −70° in the other half of the cycle as defined by the angle of the crank shaft beginning with the crank arm in a vertical position. The converse of this is that the dead zones may exist from 110° to 155° and −70° to 0° of the crank shaft. These power bands for the cycle may be similarly described in term of roller vertical position or handle position. For example, the exercise machine may have a power band as defined by the roller from the upper middle roller position (e.g. RP2) to the lower middle roller position (e.g. RP4). In another example, the exercise machine may have a power band as defined by the handle from the forward middle handle position to the rear middle handle position.

In accordance with various embodiments, the upper moment-producing mechanism 90 and the lower moment-producing mechanism 92 provide a mechanical advantage ratio of between about 0.6 and 1.4 in a power band of the cycle as defined by roller position. In various examples, the upper moment-producing mechanism 90 and the lower moment-producing mechanism 92 provide a mechanical advantage ratio of between about 0.8 and 1.1 in response to the roller being located at it midpoint of vertical travel during the cycle.

In accordance with various embodiments, the lower moment-producing mechanism 92 (e.g. the first and second lower linkages) may produce a maximum mechanical advantage on the crank shaft in response to being in a power band of the cycle. In accordance with various embodiments, the upper moment-producing mechanism 90 (e.g. first and second upper linkages) may produce a maximum mechanical advantage on the crank shaft in response to being in a power band of the cycle.

In accordance with various embodiments, the angle between the component (e.g. the upper links 138) that extends between axis D and axis C and the component (e.g. the upper reciprocating links 140) that extends between axis B and axis C may be from about 70° to 115° throughout the cycle. In various examples, this angle may between 80° and 100° in response to the first and second handles being proximate to the midpoint of their travel. In various examples, this angle may be between about 80° and 105° in response to the respective first and second rollers being at about the midpoint of their travel which is approximately the location in which the lower linkage ha maximum mechanical advantage on the crank shaft. In various examples, this angle may between 80° and 100° in response to the exercise machine being within the power band of its cycle.

The angle between the component (e.g. the upper reciprocating member) that extends between axis C and axis B and the component (e.g. the virtual crank arm) that extends between axis A and axis B may be from about 0° to 180° throughout the cycle. In various examples, this angle may between 65° and 115° in response to at least one of the respective first and second rollers being at about the midpoint of their travel, the first and second lower linkages producing a maximum mechanical advantage on the crank shaft, the first and second handles being proximate to the midpoint of their travel, or the exercise machine being within the power band of its cycle.

The angle between the component (e.g. the crank arm) that extends between axis A and axis E and the component (e.g. the lower reciprocating member) that extends between axis T and axis E may be from −20° to 165° throughout the cycle. In various examples, this angle may be between 80° and 100° in response to at least one of the respective first and second rollers being at about the midpoint of their travel, the first and second lower linkages producing a maximum mechanical advantage on the crank shaft, the first and second handles being proximate to the midpoint of their travel, or the exercise machine being within the power band of its cycle. As shown in FIG. 10, the machine 100 can further includes a user interface 102 mounted near the top of the upper support member 120. The user interface 102 can include a di play to provide information to the user, and can include user inputs to allow the user to enter information and to adjust setting of the machine, such a to adjust the resistance. The machine 100 can further include stationary handles 104 mounted near the top of the upper support member 120.

The resistance mechanism a variously discussed herein may be operatively connected to the crank shaft 125 such that the resistance mechanism resists the combined moments provided at the crank shaft from the upper moment-producing mechanism 90 and the lower moment-producing mechanism 92. The crank wheel 124 can be coupled to one or more resistance mechanism directly or through the crank shaft 125 to provide resistance to the reciprocation motion of the pedals 132 and handles 134. For example, the one or more resistance mechanism can include an air-resistance based resistance mechanism 150, a magnetism based resistance mechanism 160, a friction based resistance mechanism, and/or other resistance mechanisms. One or more of the resistance mechanism can be adjustable to provide different level of resistance at a given reciprocation frequency. Further, one or more of the resistance mechanism can provide a variable resistance that corresponds to the reciprocation frequency of the exercise machine, such that resistance increases a reciprocation frequency increases.

As shown in FIG. 8-10, the machine 100 can include an air-resistance based resistance mechanism, or air brake, 150 that is rotationally mounted to the frame 112 on an horizontal haft 166, and/or a magnetism based resistance mechanism, or magnetic brake, 160, which includes a rotor 161 rotationally mounted to the frame 112 on the same horizontal haft 166 and brake caliper 162 also mounted to the frame 112. The air brake 150 and rotor 161 are driven by the rotation of the crank wheels 124. In the illustrated embodiment, the shaft 166 is driven by a belt or chain 148 that is coupled to a pulley 146. Pulley 146 is coupled to another pulley 125 mounted coaxially with the axis A by another belt or chain 144. The pulley 125 and 146 can be used as a gearing mechanism to set the ratio of the angular velocity of the air brake 150 and the rotor 161 relative to the reciprocation frequency of the pedals 132 and handles 134. For example, one reciprocation of the pedals 132 can cause several rotation of the air brake 150 and rotor 161 to increases the resistance provided by the air brake 150 and/or the magnetic brake 160.

The air brake 150 can be similar in structure and function to the air brake 50 of the machine 10 and can be similarly adjustable to control the volume of air flow that is induced to flow through the air brake at a given angular velocity.

Figure 11:
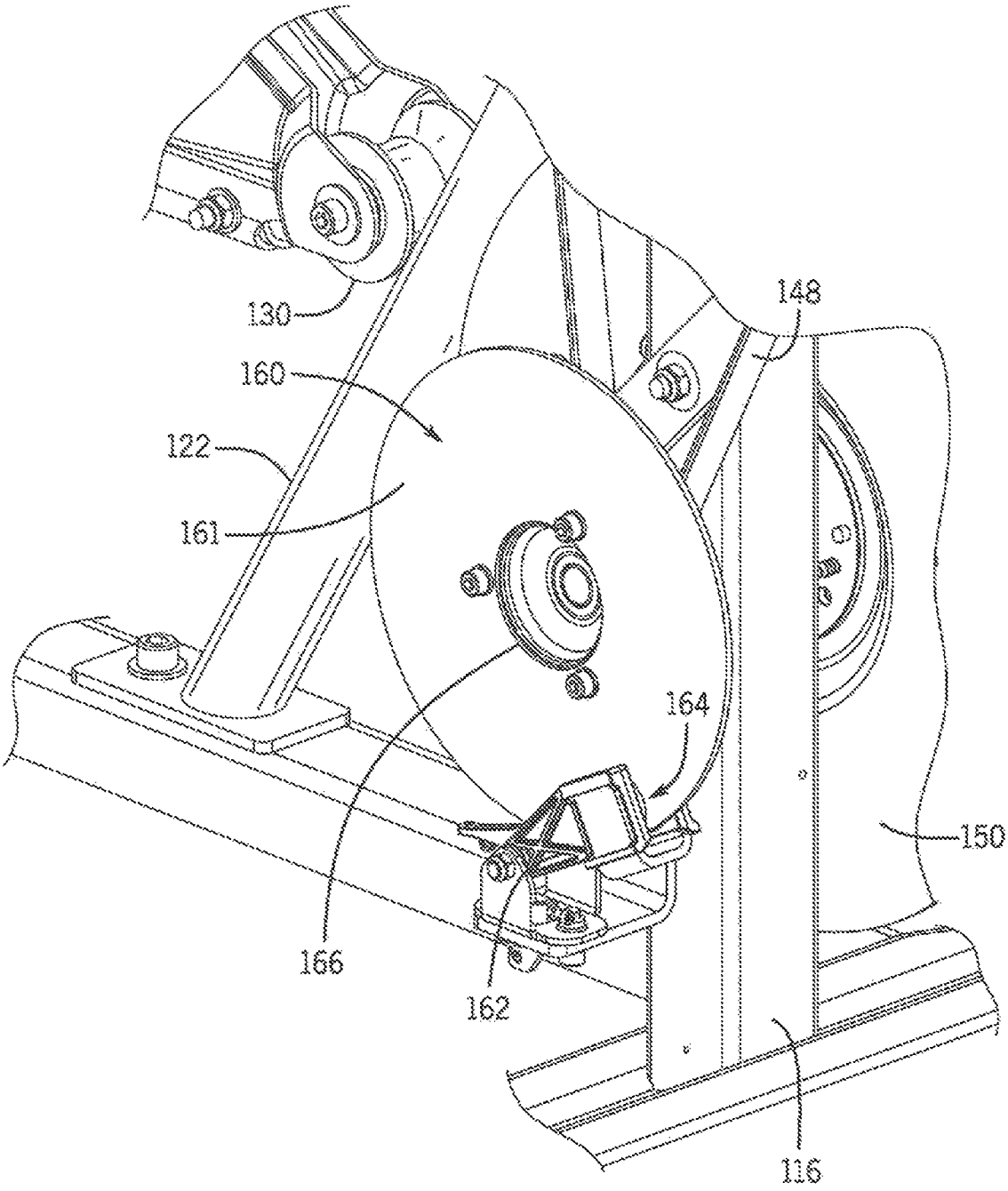
FIG. 11 is a perspective view of a magnetic brake of the machine of FIG. 8.

The magnetic brake 160 provide resistance by magnetically inducing eddy current in the rotor 161 as the rotor rotates. As shown in FIG. 11, the brake caliper 162 include high power magnet 164 positioned on opposite side of the rotor 161. As the rotor 161 rotate between the magnets 164, the magnetic field created by the magnets induce eddy current in the rotor, producing resistance to the rotation of the rotor. The magnitude of the resistance to rotation of the rotor can increase as a function of the angular velocity of the rotor, such that higher resistance is provided at high reciprocation frequencies of the pedals 132 and handle 134. The magnitude of resistance provided by the magnetic brake 160 can also be a function of the radial distance from the magnets 164 to the rotation axis of the shaft 166. As this radius increases, the linear velocity of the portion of the rotor 161 passing between the magnet 164 increases at any given angular velocity of the rotor, as the linear velocity at a point on the rotor is a product of the angular velocity of the rotor and the radius of that point from the rotation axis. In some embodiments, the brake caliper 162 can be pivotably mounted, or otherwise adjustable mounted, to the frame 116 such that the radial position of the magnet 134 relative to the axis of the shaft 166 can be adjusted. For example, the machine 100 can includes a motor coupled to the brake caliper 162 that is configured to move the magnets 164 to different radial positions relative to the rotor 161. As the magnets 164 are adjusted radially inwardly, the linear velocity of the portion of the rotor 161 passing between the magnet decreases, at a given angular velocity of the rotor, thereby decreasing the resistance provided by the magnetic brake 160 at a given reciprocation frequency of the pedals 132 and handle 134. Conversely, as the magnets 164 are adjusted radially outwardly, the linear velocity of the portion of the rotor 161 passing between the magnets increases, at a given angular velocity of the rotor, thereby increasing the resistance provided by the magnetic brake 160 at a given reciprocation frequency of the pedals 132 and handles 134.

In some embodiments, the brake caliper 162 can be adjusted rapidly while the machine 10 is being used for exercise to adjust the resistance. For example, the radial position of the magnets 164 of the brake caliper 162 relative to the rotor 161 can be rapidly adjusted by the user while the user is driving the reciprocation of the pedals 132 and/or handles 134, such as by manipulating a manual lever, a button, or other mechanism positioned within reach of the user's hands, illustrated in FIG. 10, while the user is driving the pedals 132 with his feet. Such an adjustment mechanism can be mechanically and/or electrically coupled to the magnetic brake 160 to cause an adjustment of eddy current in the rotor and thus adjust the magnetic resistance level. The user interface 102 can include a di play to provide information to the user, and can include user input to allow the user to enter to adjust setting of the machine, such as to adjust the resistance. In some embodiments, such as user-caused adjustment can be automated, such as using a button on the user interface 102 that is electrically coupled to a controller and an electrical motor coupled to the brake caliper 162. In other embodiments, such an adjustment mechanism can be entirely manually operated, or a combination of manual and automated. In some embodiments, a user can cause a desired magnetic resistance adjustment to be fully enacted in a relatively short time frame, such as within a half-seconds, within one seconds, within two seconds, within three seconds, within four seconds, and/or within five second from the time of manual input by the user via an electronic input device or manual actuation of a mechanical device. In other embodiment, the magnetic resistance adjustment time period can be smaller or greater than the exemplary time period provided above.

Figure 12:
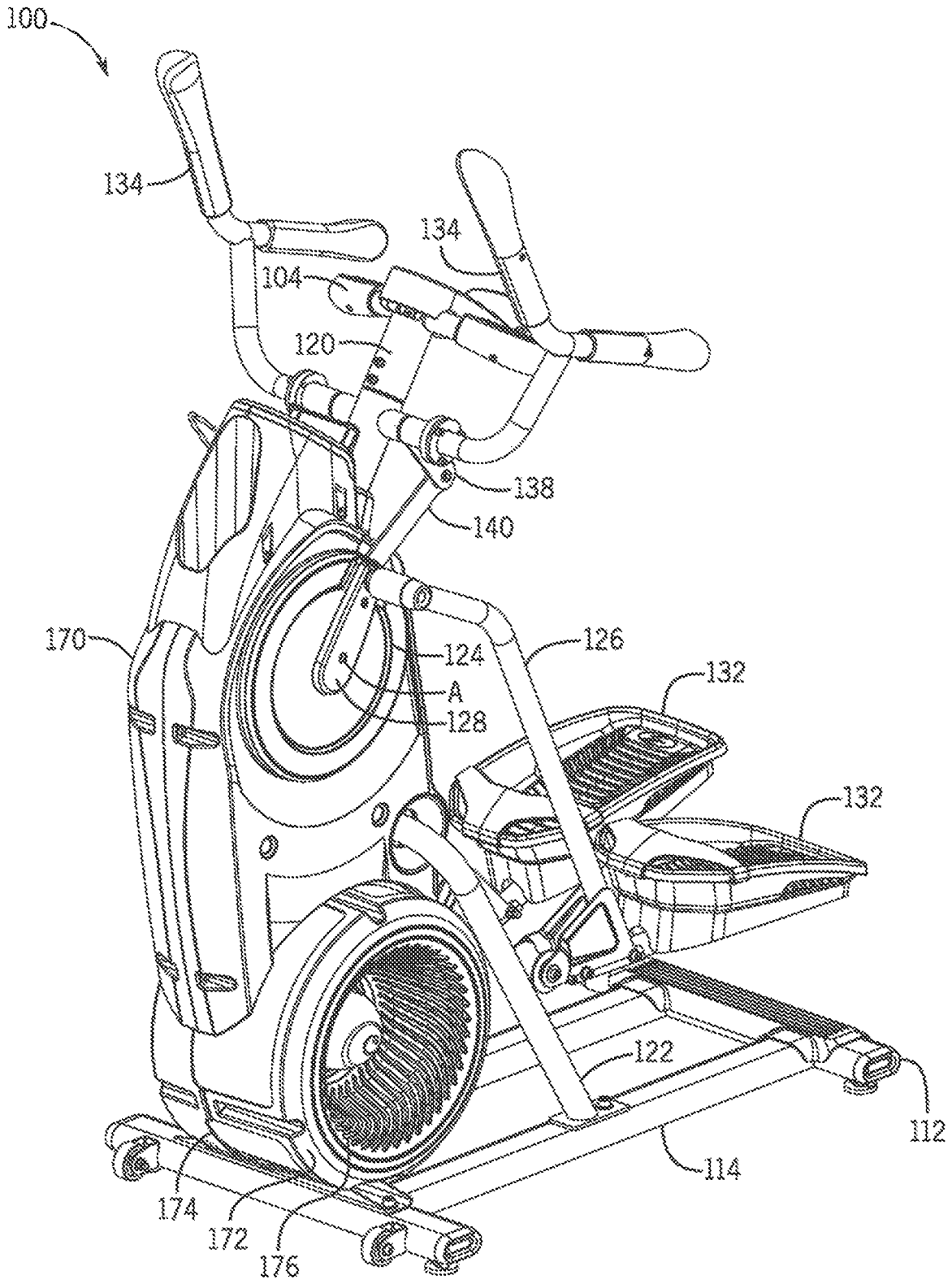
FIG. 12 is a perspective view of an embodiment of the machine of FIG. 8 with an outer housing included.
Figure 13:
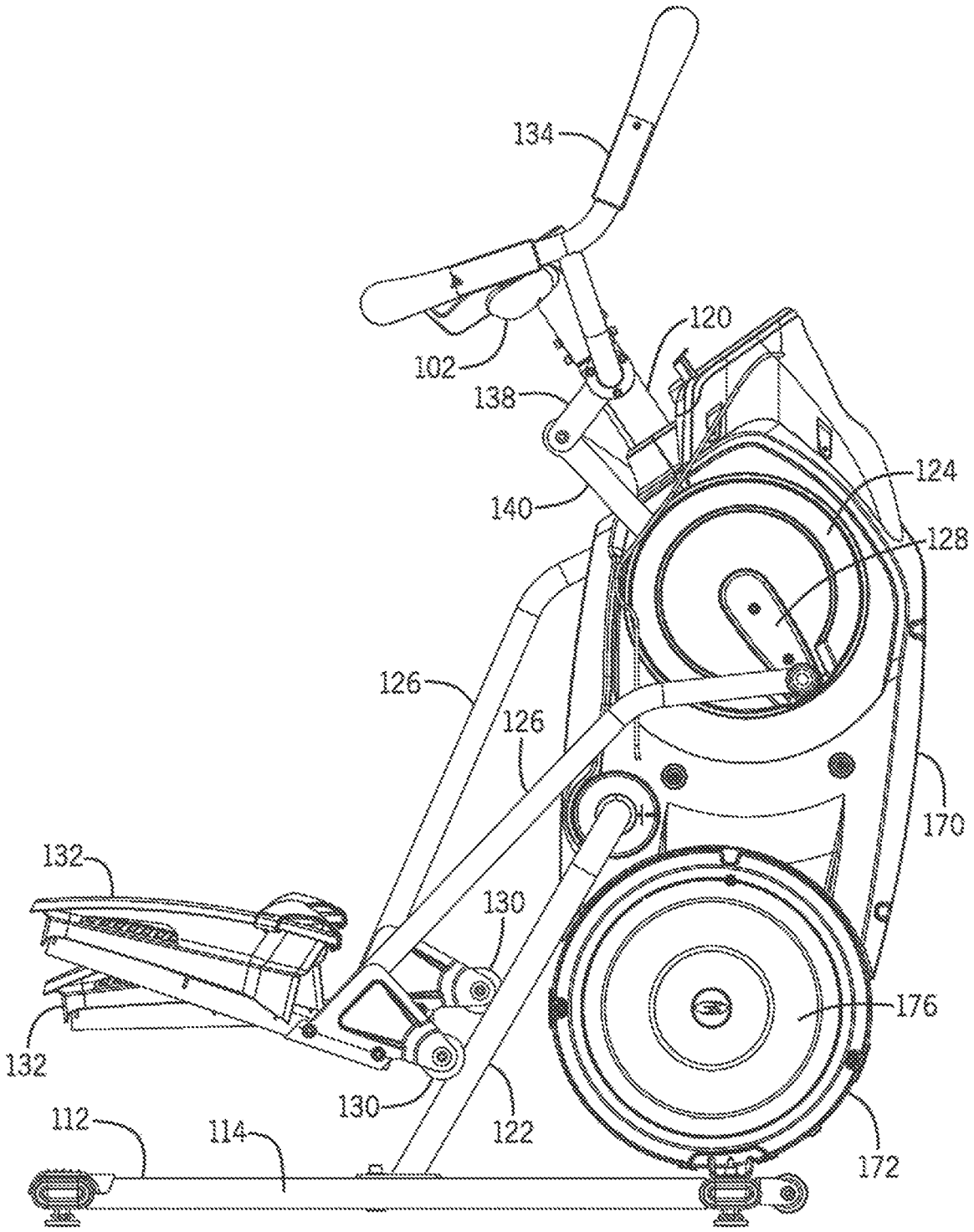
FIG. 13 is a right side view of the machine of FIG. 12.
Figure 14:
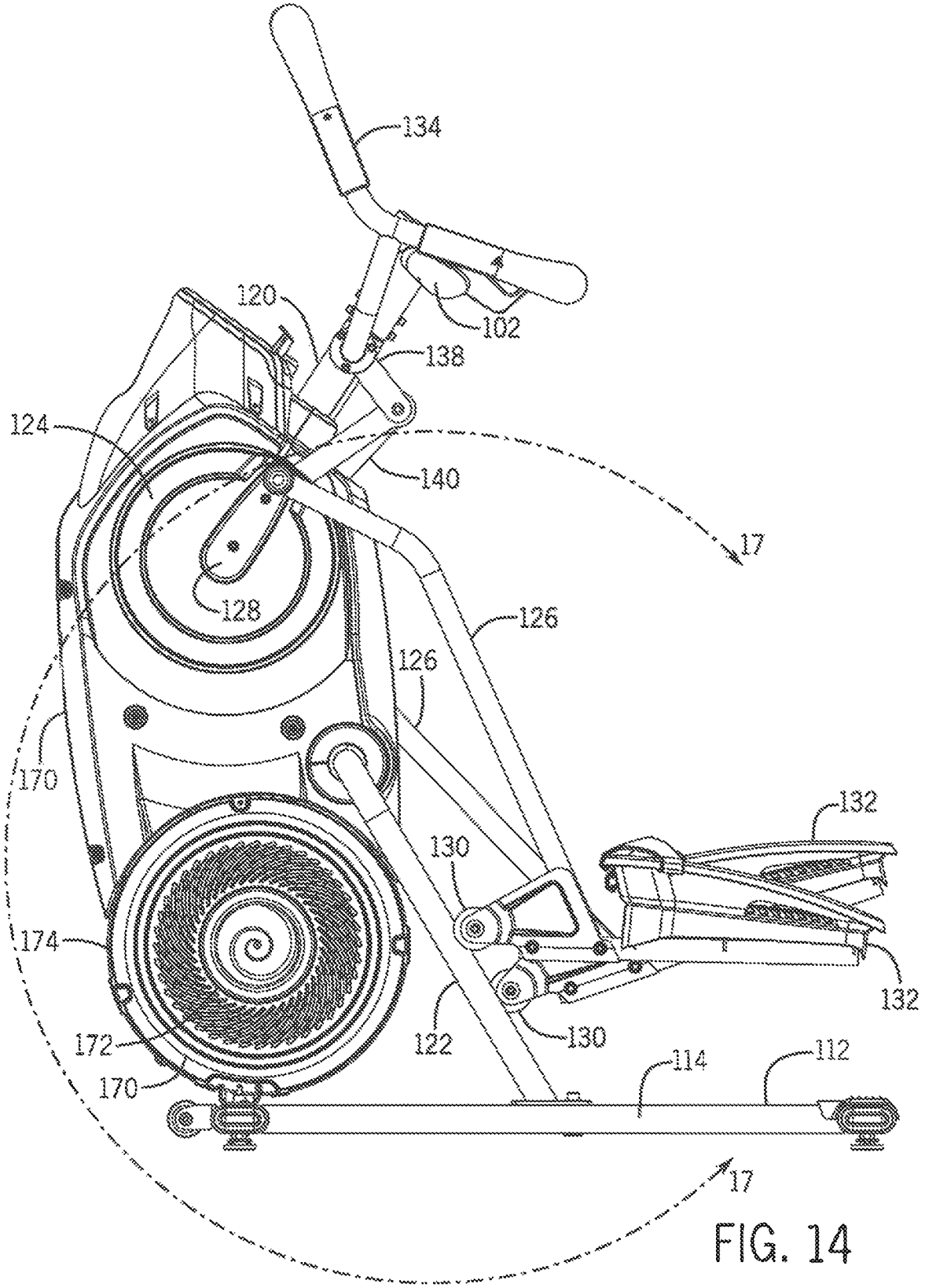
FIG. 14 is a left side view of the machine of FIG. 12.
Figure 15:
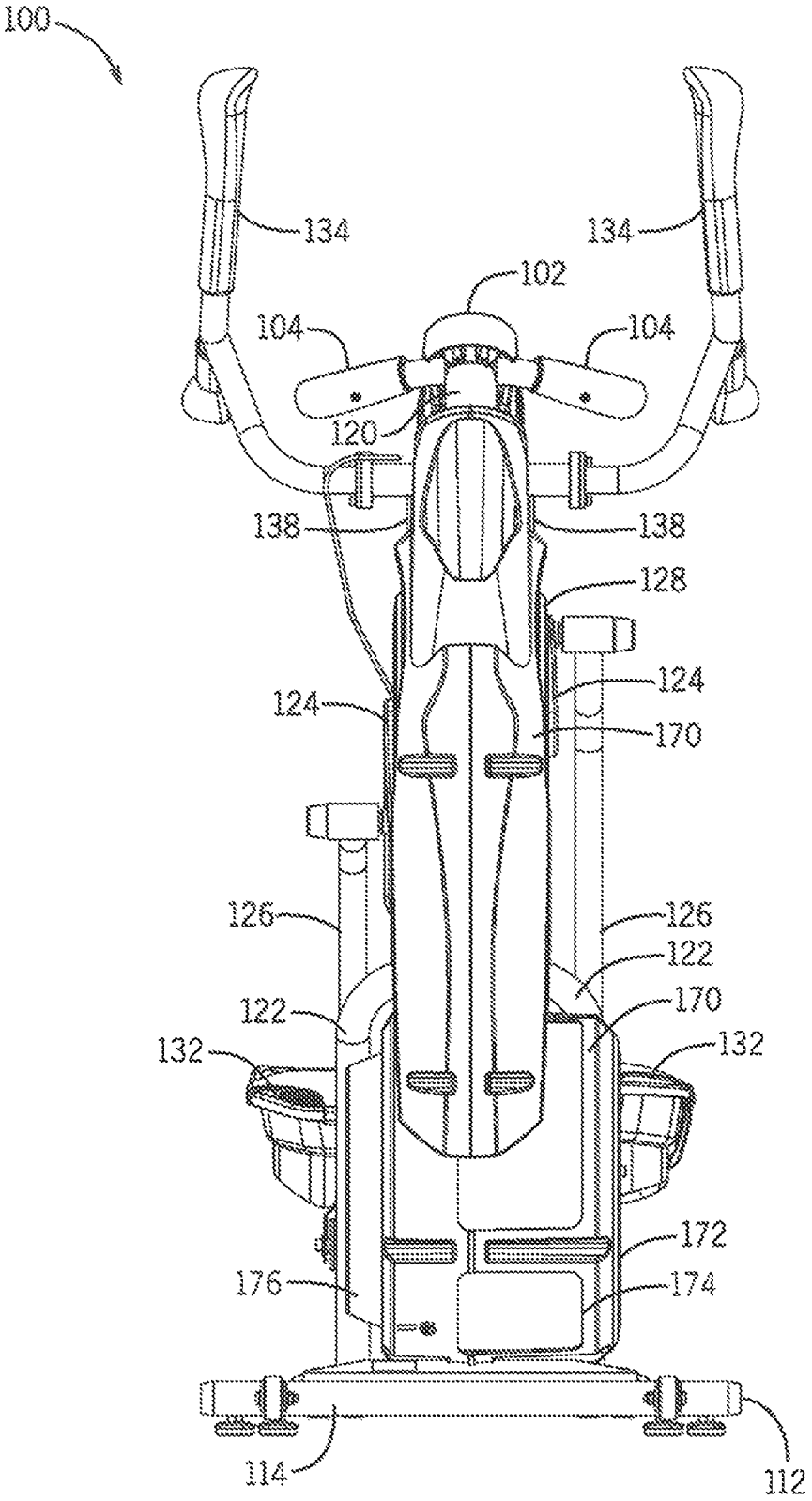
FIG. 15 is a front view of the machine of FIG. 12.
Figure 16:
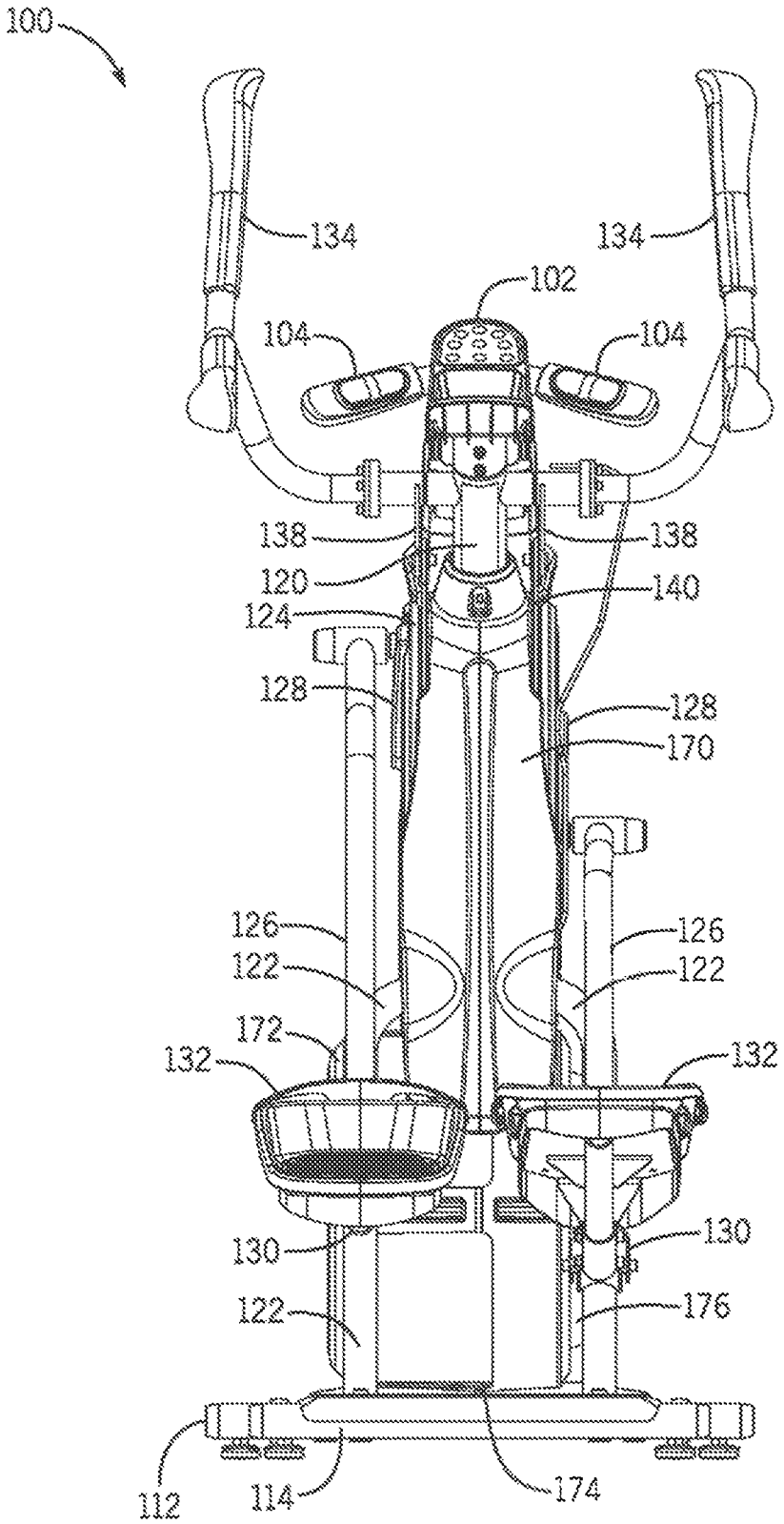
FIG. 16 is a rear view of the machine of FIG. 12.

FIG. 12-16 how an embodiment of the exercise machine 100 with an outer housing 170 mounted around a front portion of the machine. The housing 170 can house and protect portions of the frame 112, the pulleys 125 and 146, the belt or chains 144 and 148, lower portions of the upper reciprocating members 140, the air brake 150, the magnetic brake 160, motors for adjusting the air brake and/or magnetic brake, wiring, and/or other component of the machine 100. As shown in FIGS. 12, 14, and 15 the housing 170 can include an air brake enclosure 172 that include lateral inlet opening 176 to allow air into the air brake 150 and radial outlet opening 174 to allow air out of the air brake. As shown in FIGS. 13 and 15, the housing 170 can further includes a magnetic brake enclosure 176 to protect the magnetic brake 160, where the magnetic brake is included in addition to or instead of the air brake 150. The crank arm 128 and crank wheel 124 can be exposed through the housing such that the lower reciprocating member 126 can drive them in a circular motion about the axis A without obstruction by the housing 170.

FIG. 18A-G illustrate various view of one example of the exercise machine. In the example shown in FIG. 18A-G, the exercise machine may be a generally upright device that occupies a small amount of floor pace due to the generally vertical nature of the machine as a whole. As respectively shown, FIG. 18A-G depict an example isometric, front, back, left, right, top, and bottom view of the exercise machine. Each of these view also depict ornamental aspects of the exercise machine.

For purposes of this description, certain aspects, advantages, and novel feature of the embodiments of this disclosure are described herein. The disclosed methods, apparatuses, and system should not be construed as limiting in any way. Instead, the present disclosure is directed toward all novel and nonobvious features and aspects of the various disclosed embodiments, alone and in various combination and sub-combination with one another. The methods, apparatuses, and system are not limited to any specific aspects or feature or combination thereof, nor do the disclosed embodiments require that any one or more specific advantages be present or problems be solved.

As used herein, the term "a", "an" and "at least one" encompass one or more of the specified element. That is, if two of a particular element are present, one of these element is also present and thus "an" element is present. The term "a plurality of" and "plural" mean two or more of the specified element.

As used herein, the term "and/or" used between the last two of a list of elements means any one or more of the listed elements. For example, the phrase "A, B, and/or C" means "A," "B," "C," "A and B," "A and C," "B and C" or "A, B and C."

All relative and directional reference (including: upper, lower, upward, downward, left, right, leftward, rightward, top, bottom, side, above, below, front, middle, back, vertical, horizontal, height, depth, width, and so forth) are given by way of example to aid the reader's understanding of the particular embodiment described herein. They should not be read to be requirements or limitations, particularly as to the position, orientation, or use of the invention unless specifically set forth in the claims. Connection reference (e.g., attached, coupled, connected, joined, and the like) are to be construed broadly and may include intermediate members between a connection of element and relative movement between elements. As such, connection reference do not necessarily infer that two element are directly connected and in fixed relation to each other, unless specifically set forth in the claims.

Unless otherwise indicated, all number expressing properties, sizes, percentages, measurements, distances, ratios, and so forth, a used in the specification or claim are to be understood a being modified by the term "about." Accordingly, unless otherwise indicated, implicitly or explicitly, the numerical parameter set forth are approximations that may depend on the desired properties ought and/or limits of detection under standard test conditions/methods. When directly and explicitly distinguishing embodiment from discussed prior art, numbers are not approximations unless the word "about" is recited.

In view of the many possible embodiments to which the principle disclosed herein may be applied, it should be recognized that the illustrated embodiments are only examples and should not be taken a limiting the cope of the disclosure. Rather, the cope of the disclosure is at least as broad as the following exemplary claims.

The invention claimed is:

1. A stationary exercise machine comprising:

reciprocating first and second foot pedals that move in respective non-circular closed loop paths;

a stationary frame supporting the reciprocating first and second foot pedals;

a shaft rotatably mounted to the stationary frame and operatively associated with the reciprocating first and second foot pedals, via a respective crank link member, to rotate about a shaft axis in response to movement of the reciprocating first and second foot pedals;

at least one rotatable resistance mechanism operatively associated with the shaft and configured to provide variable resistance to rotation of the shaft; and a handle pivotally coupled to the stationary frame such that the handle pivots about a first axis when driven by a user's hand, wherein the handle is operatively coupled to the shaft by a linkage not including the respective crank link member to drive rotation of the shaft when the handle is driven by the user's hand, wherein the linkage has an input portion associated with the handle and an output portion configured to drive rotation of the shaft, wherein the input portion of the linkage reciprocates while the output portion of the linkage pivots about a pivot point spaced from the shaft axis when the handle is driven by the user's hand, and the pivot point orbits the shaft axis as the handle reciprocates.

2. The stationary exercise machine of claim 1, further comprising reciprocating first and second foot members coupling a respective one of the reciprocating first and second foot pedals to the respective crank link member.

3. The stationary exercise machine of claim 2, wherein each of the respective crank link members is pivotally connected to the respective one of the reciprocating first and second foot members.

4. The stationary exercise machine of claim 3, wherein each of the reciprocating first and second foot members is constrained to move along a path defined by an inclined members of the frame.

5. The stationary exercise machine of claim 4, wherein each of the reciprocating first and second foot members is supported on the inclined member by a respective roller.

6. The stationary exercise machine of claim 5, wherein the inclined members defines a respective linear path for each of the respective rollers.

7. The stationary exercise machine of claim 3, wherein each of the crank link members is rigidly coupled to the shaft.

8. The stationary exercise machine of claim 1, wherein the input portion of the linkage is provided by a first link member fixed to the handle and pivotally coupled to the frame such that the first link pivots about the first axis in synchrony with the handle.

9. The stationary exercise machine of claim 8, wherein the linkage further comprises:

a second link member having a first end coupled to an end of the first link member opposite from the first axis, and a second end opposite the first end; and wherein the output portion of the linkage is provided by a third link member pivotally coupled to the second end of the second link member.

10. The stationary exercise machine of claim 9, wherein the third link member comprises a disk configured to rotate about the shaft axis.

11. The stationary exercise machine of claim 1, wherein the at least one rotatable resistance mechanism is configured to provide resistance that increases as a function of a reciprocation frequency of the reciprocating first and second foot pedals.

12. The stationary exercise machine of claim 1, wherein the output portion of the linkage is coupled to a disk configured to rotate the shaft when the handle is driven by the user's hand.

13. The stationary exercise machine of claim 1, wherein rotation of the shaft is transmitted to the at least one rotatable resistance mechanism via at least one belt.

14. The stationary exercise machine of claim 1, wherein each of the non-circular closed loop paths of the reciprocating first and second pedals define a respective major axis extending between two points in the non-circular closed loop path that are furthest apart from each other, and the major axis of each of the non-circular closed loop paths is inclined at least forty-five degrees relative to a horizontal plane.

15. The stationary exercise machine of claim 1 wherein the at least one rotatable resistance mechanism includes at least one of an air-resistance based resistance mechanism and a magnetic resistance mechanism.

* * * * *